US007197995B2

(12) United States Patent
Hayashi et al.

(10) Patent No.: US 7,197,995 B2
(45) Date of Patent: Apr. 3, 2007

(54) NEEDLE BAR THREAD GUIDE FOR SEWING MACHINE

(75) Inventors: Kazutoshi Hayashi, Nagoya (JP); Noboru Mizuno, Nagoya (JP); Masayuki Hori, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 22 days.

(21) Appl. No.: 11/187,939

(22) Filed: Jul. 25, 2005

(65) Prior Publication Data

US 2006/0021557 A1 Feb. 2, 2006

(30) Foreign Application Priority Data

Jul. 27, 2004 (JP) ..... 2004-218214

(51) Int. Cl.
*D05B 55/00* (2006.01)

(52) U.S. Cl. ..... 112/225; 112/302

(58) Field of Classification Search ..... 112/302, 112/225, 224, 226, 241
See application file for complete search history.

(56) References Cited

U.S. PATENT DOCUMENTS 927,795 A * 7/1909 Kastrup ..... 112/254
3,040,681 A * 6/1962 Kastrup ..... 112/302
3,584,589 A * 6/1971 Pirrello ..... 112/295
4,215,641 A * 8/1980 Dobrjanskyj et al. ..... 112/278
4,947,773 A * 8/1990 Jean Blanc ..... 112/302
5,386,791 A * 2/1995 Sato et al. ..... 112/302
5,441,003 A * 8/1995 Hashiride ..... 112/259
5,873,318 A * 2/1999 Bohlinger et al. ..... 112/475.08
6,382,119 B2 * 5/2002 Tajima et al. ..... 112/241
6,957,617 B2 * 10/2005 Hori ..... 112/302
7,082,885 B2 * 8/2006 Shoji et al. ..... 112/225

FOREIGN PATENT DOCUMENTS

JP 58-35720 B2 8/1983
JP 11-000489 A 1/1999
JP 2004-236673 A 8/2004

* cited by examiner

*Primary Examiner*—Danny Worrell
(74) *Attorney, Agent, or Firm*—Oliff & Berridge, PLC

(57) ABSTRACT

A needle bar thread guide for a sewing machine includes a thread guide body mounted on a needle bar and having a threading portion for threading the sewing machine, an introducing portion formed on the thread guide body for introducing a needle thread to the threading portion, and a fall-off preventing member disposed at a position near to spaces over and below the thread guide body. The fall-off preventing member allows the needle thread to be introduced via the introducing portion to the threading portion and prevents the needle thread introduced to the threading portion from falling off from the introducing portion.

8 Claims, 41 Drawing Sheets

NEEDLE BAR THREAD GUIDE FOR SEWING MACHINE

CROSS-REFERENCE TO RELATED APPLICATIONS

This application is based upon and claims the benefit of priority from the prior Japanese Patent Application No. 2004-218214, filed on Jul. 27, 2004 the entire contents of which are incorporated by reference.

BACKGROUND OF THE INVENTION

1. Field of the Invention

This invention relates to a needle bar thread guide which can readily set a needle thread on a threading portion of a thread guide body provided on a lower end of a needle bar in a sewing machine and prevent the needle thread set on the threading portion from falling off.

2. Description of the Related Art

Many conventional sewing machines have been provided with a needle bar thread guide mounted on a lower end of a needle bar of a sewing machine for guiding a needle thread set on a thread take-up lever along the needle bar to a thread eye of a sewing needle. When the needle thread is set on the needle bar thread guide before sewing, the needle thread can be prevented from uselessly swinging near the lower end of the needle bar in vertical movement of the needle bar during sewing.

Various types of needle bar thread guides have been suggested. For example, JP-B-S58-35720 discloses an overlock sewing machine includes a first threading portion formed so as to be opened in one direction and a second threading portion provided below the first threading portion and formed into the shape of a continuous ring, both portions being provided on the lower end of the needle bar. In the disclosed construction, before being passed through the thread eye of the sewing needle, the needle thread is set on the first threading portion and then on the second threading position from above. As a result, the needle thread can be limited to a position near the sewing needle, whereby the needle bar can be prevented from swinging during sewing.

Furthermore, JP-A-11-489 discloses another sewing machine includes a thread guide device having provided over a needle connecting member and having a slit formed so as to be open in one direction. The disclosed sewing machine further includes a needle bar thread guide disposed below the thread guide device and the needle connecting member and formed so as to be open in one direction. The sewing machine is constructed so that the needle thread can readily be set both on the slits and on the needle bar thread guide.

In the sewing machine disclosed in JP-B-S58-35720, however, the second threading portion is formed into a continuous ring shape. Accordingly, the needle thread is passed from above so that the second threading portion is threaded. This renders the threading work troublesome.

Furthermore, in the sewing machine disclosed in JP-A-11-489, each of the thread guide device and needle bar thread guide both disposed over the needle connecting member is formed so as to be open in one direction. Accordingly, for example, the needle thread swings hard when a firm thread such as nylon thread is used for the sewing. In such a case, the needle thread easily falls off from the thread guide device and/or needle bar thread guide when swinging hard.

In view of the above-noted problem, it is expected to devise shapes of components of the needle bar thread guide so that the needle thread can readily be set on and can be prevented from falling off. However, in order that the above-noted mutually contradictory functions may be compatible with each other, it is supposed that the shapes of components of the needle bar thread guide would be complicated considerably. When the shapes of components of the needle bar thread guide become complicated considerably, the components are necessitated to be in high precision and accordingly, the costs of the components are increased.

Furthermore, it would be considerably difficult to reliably prevent the needle thread from falling off only by devices in the shapes of components of the needle bar thread guide. When the needle thread disengages the threading portion of the needle bar thread guide during sewing, the sewing operation becomes unstable and the quality of sewn products would be reduced. Furthermore, there is a possibility of occurrence of thread breakage in a needle thread.

SUMMARY OF THE INVENTION

Therefore, an object of the present invention is to provide a needle bar thread guide for a sewing machine in which the needle thread can readily be set on the needle bar thread guide, the needle thread set on the needle bar thread guide can reliably be prevented from falling off so that a sufficient thread retaining performance can be achieved.

An embodiment of the present invention provides a needle bar thread guide for a sewing machine, the sewing machine including at least one needle bar, the thread guide comprising a thread guide body provided on the needle bar and having a threading portion for threading the sewing machine, an introducing portion provided on the thread guide body for introducing a needle thread to the threading portion, and a fall-off preventing member provided at a position near to spaces over and below the thread guide body, the fall-off preventing member allowing the needle thread to be introduced via the introducing portion to the threading portion and preventing the needle thread introduced to the threading portion from falling off from the introducing portion.

The thread guide body provided on the lower end of the needle bar has the introducing portion and the fall-off preventing member. Accordingly, when introduced through the introducing portion to the threading portion, the needle thread can reliably be introduced to the threading portion without disturbance of the fall-off preventing member. Furthermore, the needle thread introduced to the threading portion can reliably be prevented by the fall-off preventing members provided on the upper and lower portions of the thread guide body.

In another embodiment, the fall-off preventing member is provided at a position near to spaces over and below the introducing portion. When the needle bar thread guide is thus constructed, the needle thread introduced through the introducing portion to the threading portion can be prevented from falling off effectively and reliably in the introducing portion.

In further another embodiment, the fall-off preventing member has an upper fall-off preventing portion and a lower fall-off preventing portion, and the upper fall-off preventing portion bends the needle thread in cooperation with the introducing portion when the needle thread is introduced to the threading portion. In still further another embodiment, the lower fall-off preventing portion bends the needle thread in cooperation with the introducing portion when the needle thread is introduced to the threading portion.

BRIEF DESCRIPTION OF THE DRAWINGS

Other objects, features and advantages of the present invention will become clear upon reviewing the following description of the embodiment with reference to the accompanying drawings, in which.

DETAILED DESCRIPTION OF THE INVENTION

Figure 1:
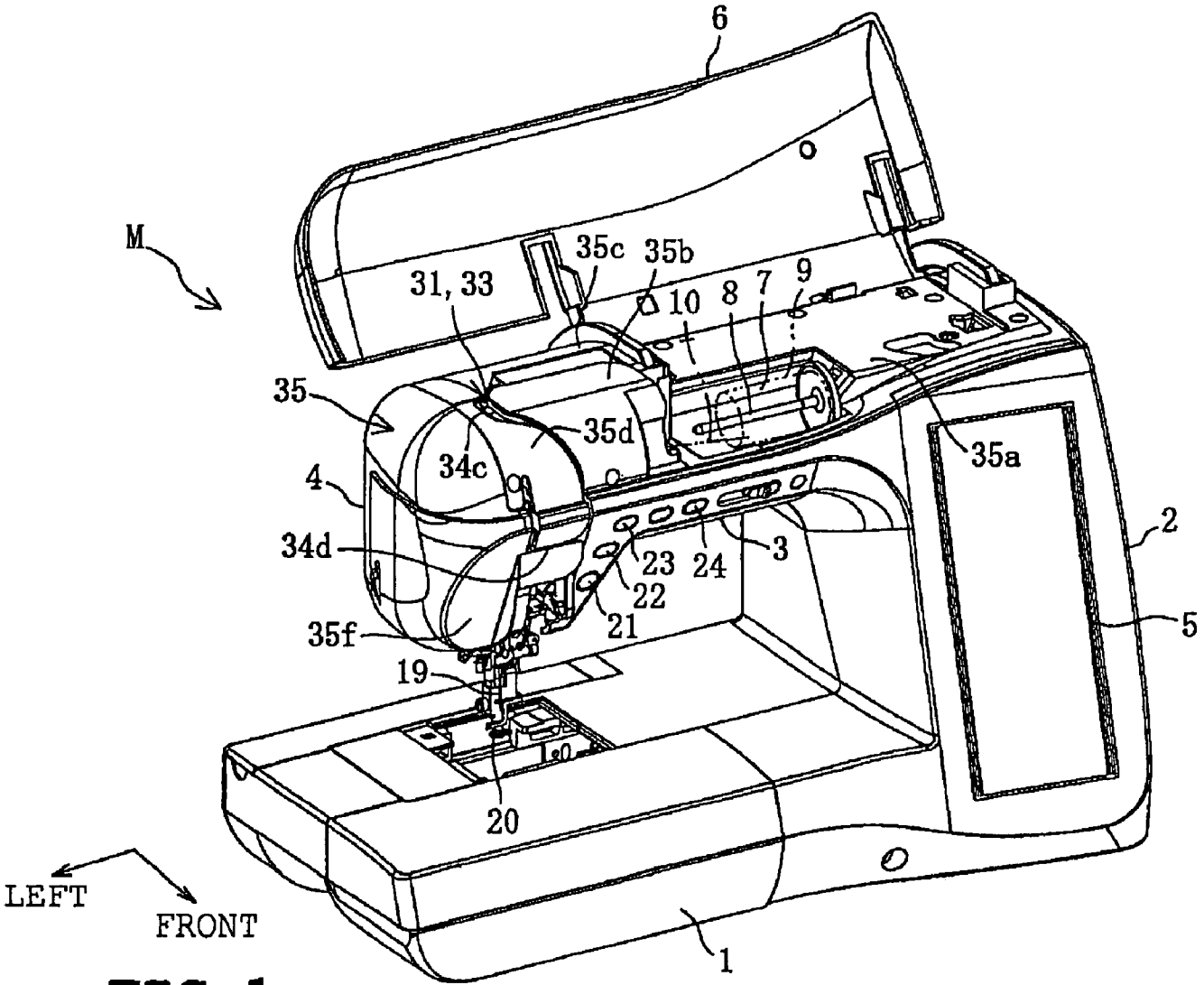
FIG. 1 is a perspective view of a sewing machine provided with a needle bar thread guide of one embodiment of the present invention.
Figure 2:
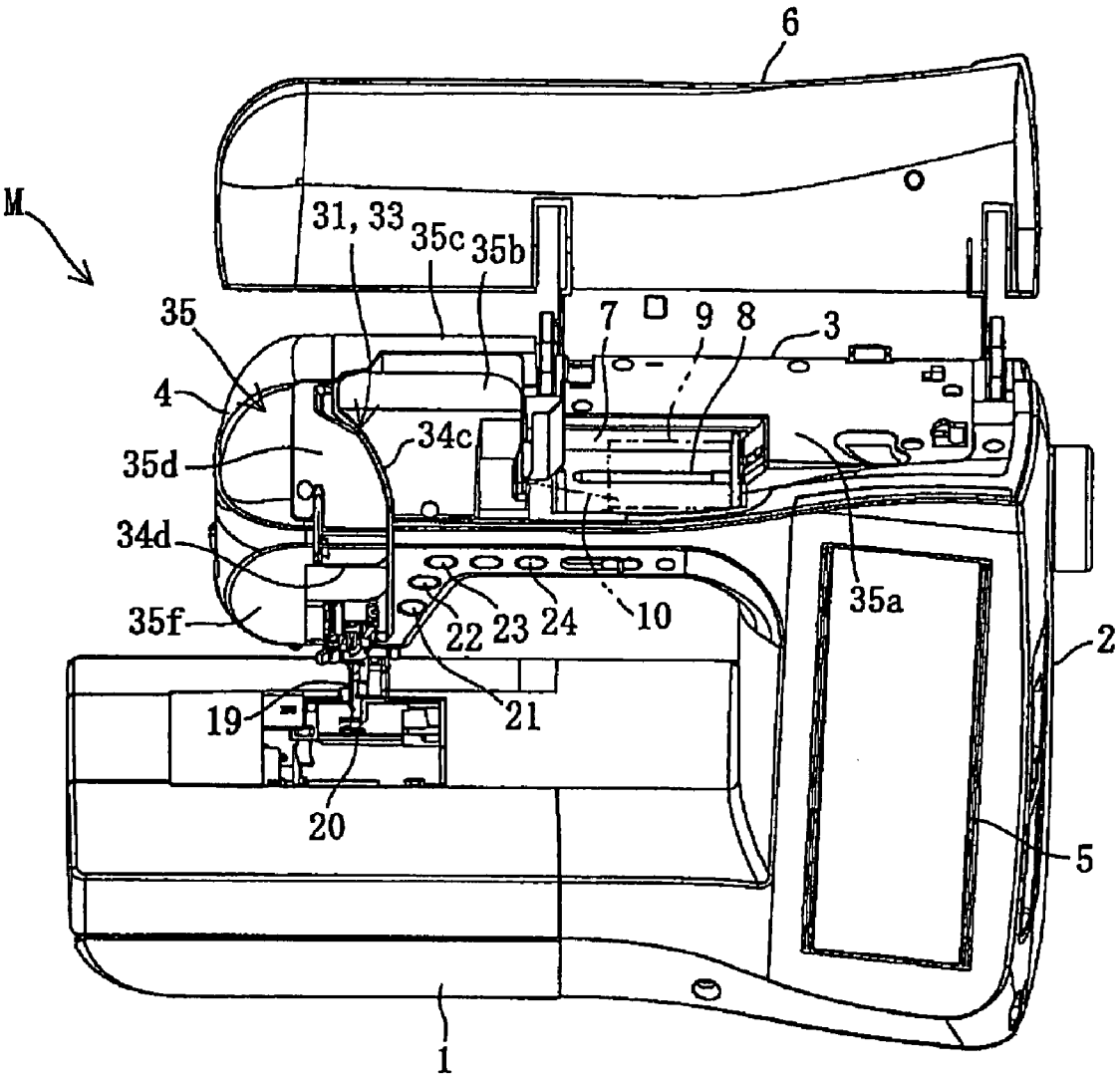
FIG. 2 is also a perspective view of the sewing machine as viewed from above.
Figure 3:
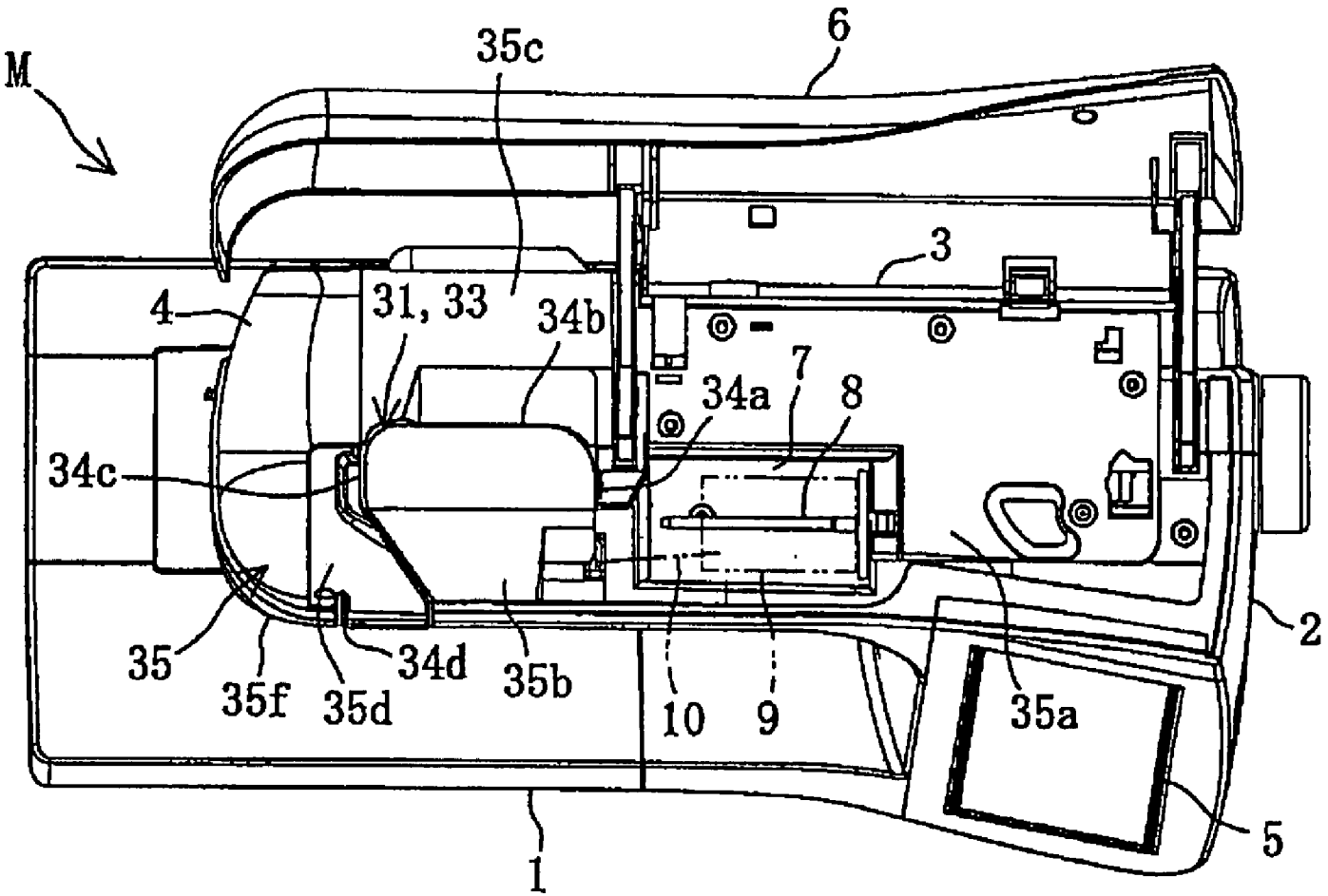
FIG. 3 is a plan view of the sewing machine.
Figure 4:
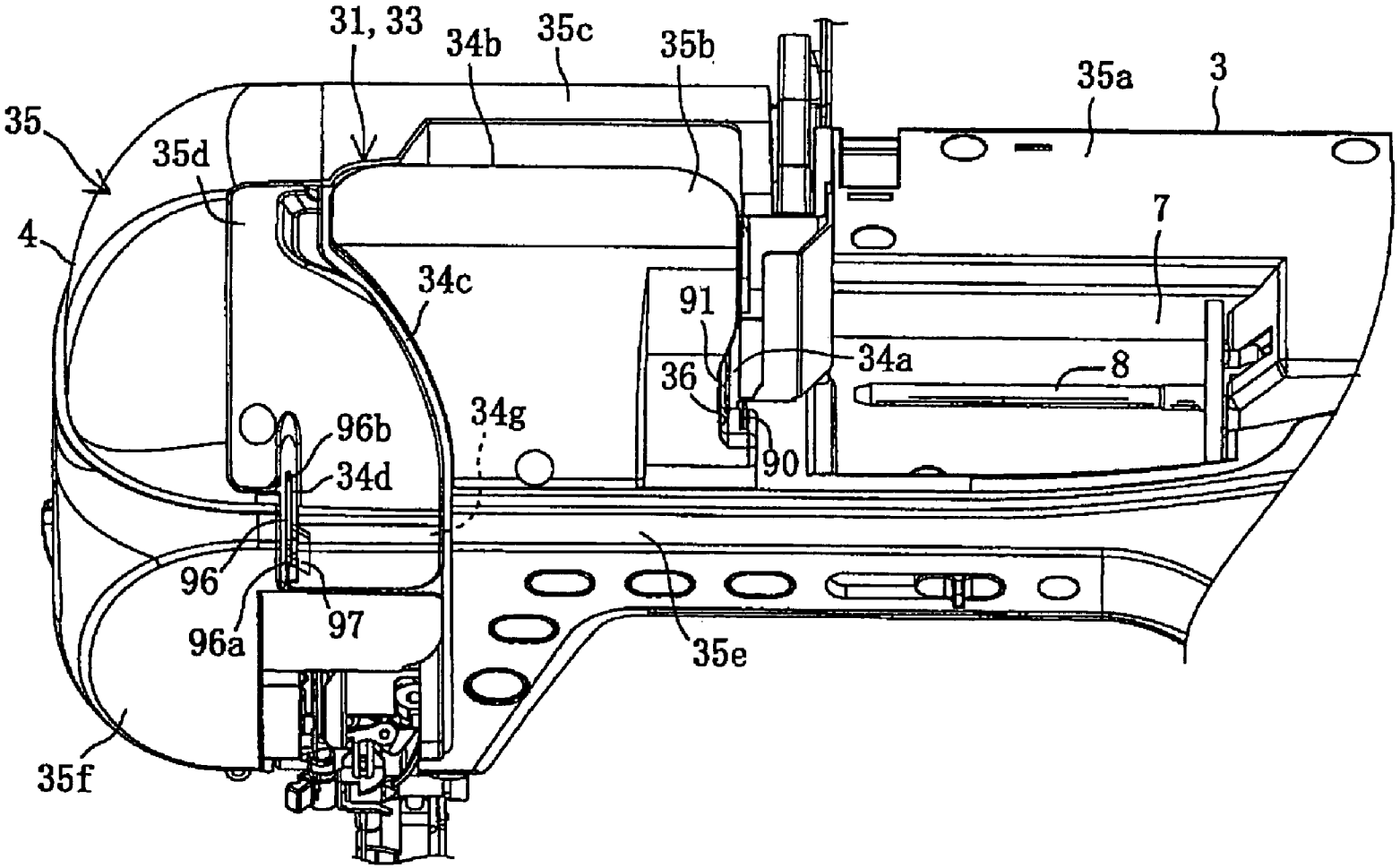
FIG. 4 is a partially enlarged view of the sewing machine in FIG. 2.

One embodiment of the present invention will be described with reference to FIGS. 1 through 25C. Referring to FIGS. 1 to 3, a sewing machine M includes a sewing bed 1, a pillar 2 standing from a right end of the bed 1, a sewing arm 3 extending leftward from an upper end of the pillar 2 so as to be opposed along the bed 1 and a machine head 4 located at a left end of the arm 3. A needle plate (not shown) is mounted on the bed 1, and a shuttle (not shown) is provided under the needle plate. A bobbin on which a needle thread is wound is detachably attached to the shuttle. A large vertically elongated liquid crystal display 5 is mounted on a front of the pillar 2.

A cover 6 is mounted on the arm 3 so as to cover an upper part of the arm 3. The cover 6 extends over an entire length of the arm 3 and is pivotally mounted on an upper rear of the arm 3 so as to be opened and closed about a horizontal axis. A thread accommodating recess 7 is formed in an upper part of the arm 3 on the right of the sewing head 4. A spool pin 8 is provided in the recess 7. A thread spool 9 serving as a thread supply is attached to the spool pin 8 thereby to be accommodated sideways in the recess 7. A needle thread 10 is drawn from the thread spool 9 through a plurality of threaded portions such as a thread tension regulator 14, a thread take-up spring 15 and a thread take-up lever 13 sequentially to be finally passed through a thread eye 19*a* of a sewing needle 19 attached to a lower end of a needle bar 11 (see FIGS. 17A and 18A).

Referring to FIGS. 3 to 5 and 8, in the head 4 are provided the needle bar 11, a presser bar 12, the thread take-up lever 13, the thread tension regulator 14, a thread take-up spring 15, an automatic threading device 16, an automatic needle threading mechanism 17 and the like. The needle bar 11 is mounted on a sewing machine frame so as to be vertically reciprocated. The needle bar 11 has a lower end on which a needle bar thread guide 18 and the sewing needle 19 are mounted. The needle bar 11 is vertically driven by a sewing machine driving mechanism (not shown) including a sewing machine motor 28 (not shown).

The presser bar 12 is disposed in the rear of the needle bar 11 and mounted on the sewing machine frame so as to be vertically movable. A presser foot 20 (see FIGS. 1 and 2) is attached to a lower end of the presser bar 12. On the front of the arm 3 are provided a sewing start switch 21, a sewing finish switch 22, an automatic threading preparation switch 23, an automatic threading start switch 24 and the like in a row, as shown in FIGS. 1 and 2.

The needle bar thread guide 18 mounted on the lower end of the needle bar 11 will now be described. Referring to FIGS. 8 to 14, a needle connecting member 25 is mounted on a lower end of the needle bar 11. The needle bar thread guide 18 is a combination of bent plates and includes a thread guide body 26, a fall-off preventing member 27 and the like. The thread guide body 26 includes a horizontal first needle bar thread guide 26*a* located over the needle connecting member 25, a horizontal second needle bar thread guide 26*b* located below the needle connecting member 25, a fixing portion 26*d* extending upward from the first needle bar thread guide 26*a* and the like. The fall-off preventing member 27 is disposed near to upper and lower sides of the first needle bar thread guide 26*a* of the thread guide body 26. The first and second needle bar thread guides 26*a* and 26*b* are connected at left ends to a vertical connecting wall 26*c*, as shown in FIGS. 15A through 15D. The fixing portion 26*d* is bent upward at a rear end of the first needle bar thread guide 26*a*. The thread guide body 26 is fixed to the lower end of the needle bar 11 by a set screw 29 (see FIG. 13).

A fixing screw 25*a* is mounted on the needle connecting member 25 for detachably fixing an upper end of the needle 19 to the needle bar 11. A supporting member 28 is also fixed to the lower end of the needle bar 11 by the set screw 29. The needle connecting member 25 is supported by the supporting member 28 so as to be prevented from falling off from the needle bar 11 even when the fixing screw 25*a* is loosened.

The first needle bar thread guide 26*a* includes an introducing portion 26*e* introducing the needle thread 10 and a threading portion 26*f* continuous to the introducing portion 26*e*. The second needle bar thread guide 26*b* is formed into a mere threading hook which hooks the needle thread 10 on the right of the needle thread 10.

The fall-off preventing member 27 comprises a thin plate-like member and includes an upper fall-off preventing member 27*a*, a lower fall-off preventing member 27*c* disposed substantially in parallel to the upper fall-off preventing member 27*a* and a fixing portion 27*e* continuous to the upper fall-off preventing member 27*a*. The upper and lower fall-off preventing members 27*a* and 27*c* and the fixing portion 27*e* are formed integrally with one another. The upper and lower fall-off preventing members 27*a* and 27*c* are vertically spaced away from each other and are assembled so as to vertically sandwich the first needle bar thread guide 26*a* therebetween. The upper and lower fall-off preventing members 27*a* and 27*c* are secured between the needle bar 11 and the needle connecting member 25.

The upper fall-off preventing member 27*a* has a curved upper distal end 27*b* formed so as to correspond to an upper portion of the introducing portion 26*e*. The lower fall-off preventing member 27*c* has a curved lower distal end 27*d* formed so as to correspond to a lower portion of the introducing portion 26*e*. The upper distal end 27*b* is formed by upwardly bending the same along a horizontal polygonal line L1 by a predetermined angle. The lower distal end 27*d* is also formed by upwardly bending the same along a horizontal polygonal line (not shown) by a predetermined angle.

Figure 13:
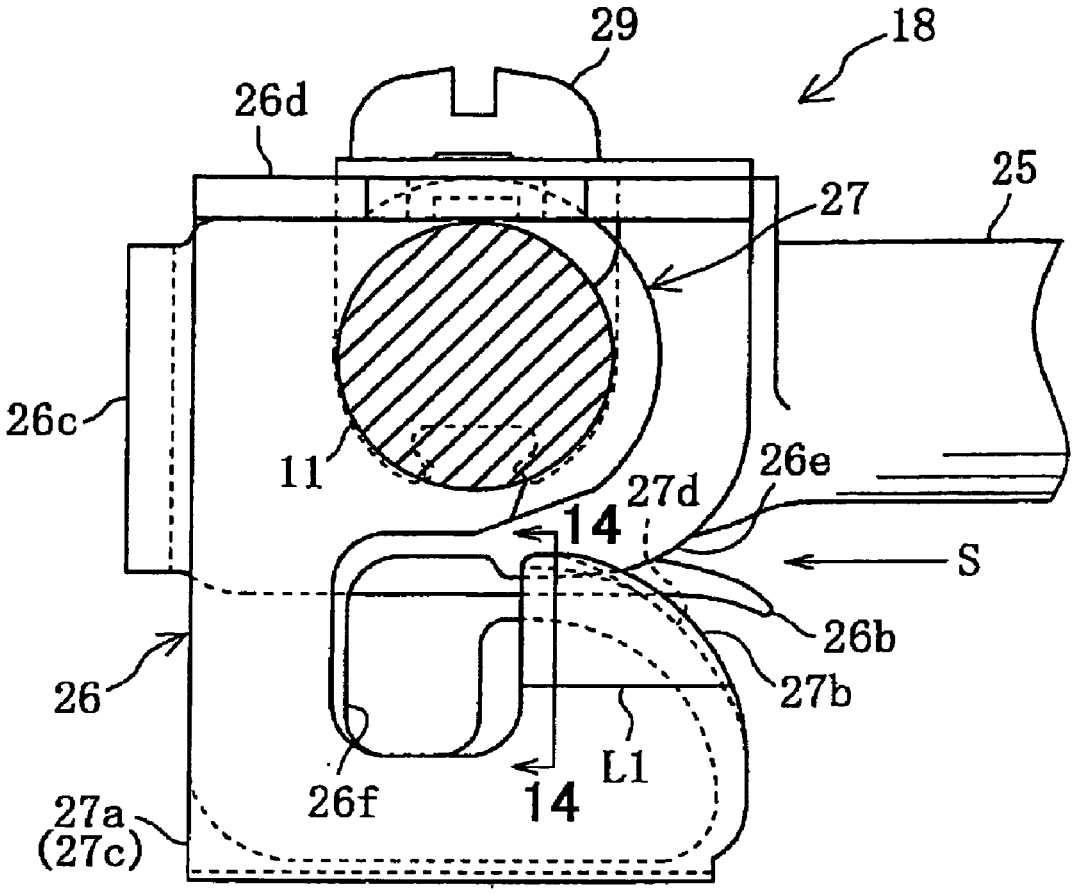
FIG. 13 is a plan view of the needle bar thread guide.
Figure 14:
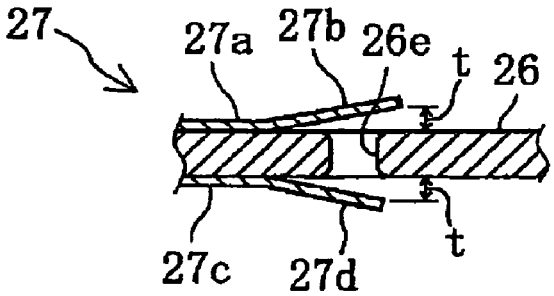
FIG. 14 is a longitudinal section taken along line 14—14 in FIG. 13.
Figure 15A:
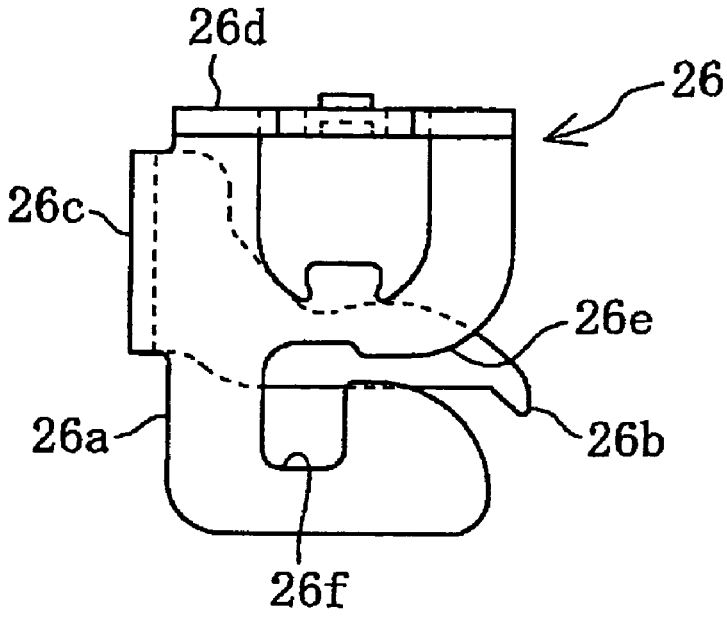
FIGS. 15A through 15D are plan, front, right side and bottom views of the thread guide body respectively.
Figure 15B:
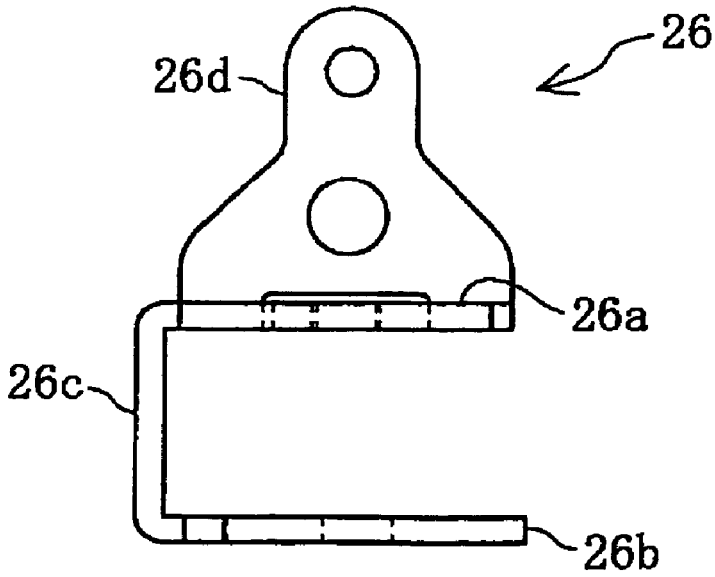
Figure 15C:
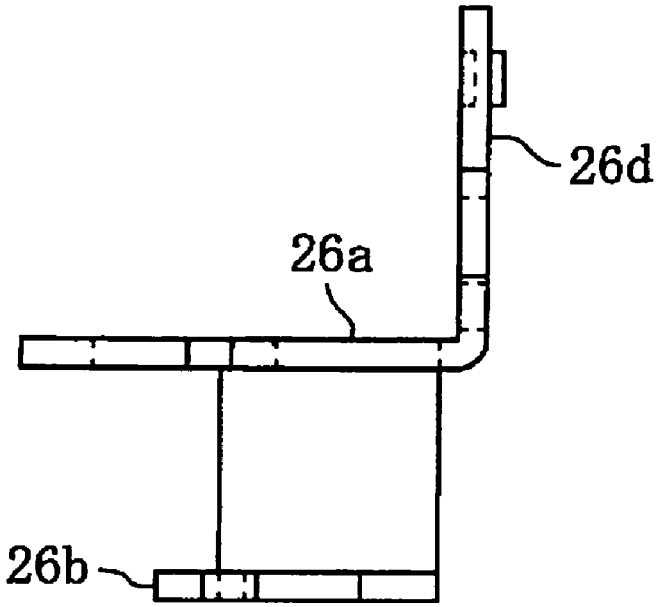
Figure 15D:
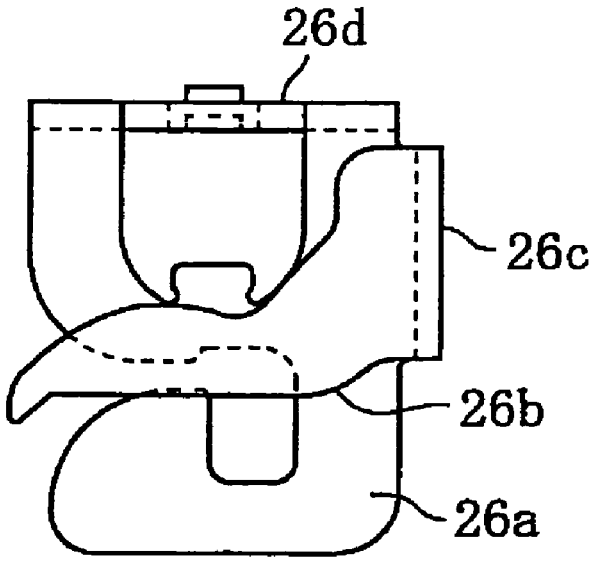

More specifically, as shown in FIG. 14, the upper distal end 27*b* includes a rear end assuming an upper nearby position spaced away upward from the first needle bar guide 26*a* by a predetermined gap t so that the needle thread is capable of passing through the gap. With this, the lower distal end 27*d* includes a rear end assuming a lower nearby position spaced away downward from the first needle bar thread guide 26*a* by the predetermined gap t so that the needle thread is capable of passing through the gap. Furthermore, as shown in FIG. 13, the rear ends of the upper and lower distal ends 27*b* and 27*d* have such a positional relation as to slightly overlap a front end of the introducing portion 26*e* of the thread guide body 26 from frontward. At a final stage of transfer of the needle thread 10, the needle thread 10 to be set is moved toward a space between the introducing portion 26*e* of the first needle bar thread guide 26*a* and the second needle bar thread guide 26*b* in the needle thread introducing direction as shown by arrow S in FIG. 13 by a threading hook 76 of a thread guide threading mechanism 70 as will be described later.

Figure 16A:
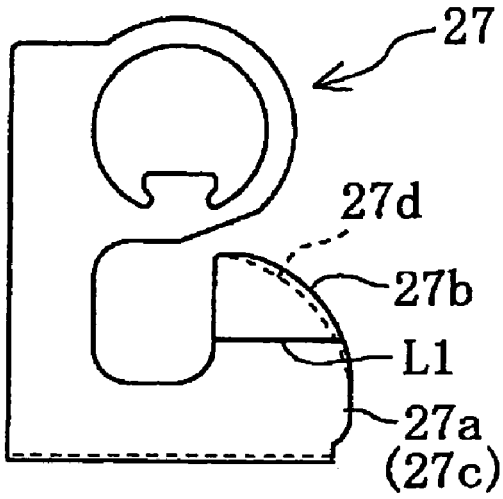
FIGS. 16A through 16C are plan, front and right side views of a fall-off preventing member.

The upper distal end 27*b* has a bending start end which is a curved edge as shown in FIGS. 13 and 16A. The lower distal end 27*d* also has a bending start end which is a curved edge. The bending start end of the upper distal end 27*b* is located upstream (rightward) by a predetermined dimension relative to the bending start end of the lower distal end 27*d*. As a result, the time the needle thread 10 is bent by the upper fall-off preventing member 27*a* is earlier than the time the needle thread 10 is bent by the lower fall-off preventing member 27*c*.

Figure 5:
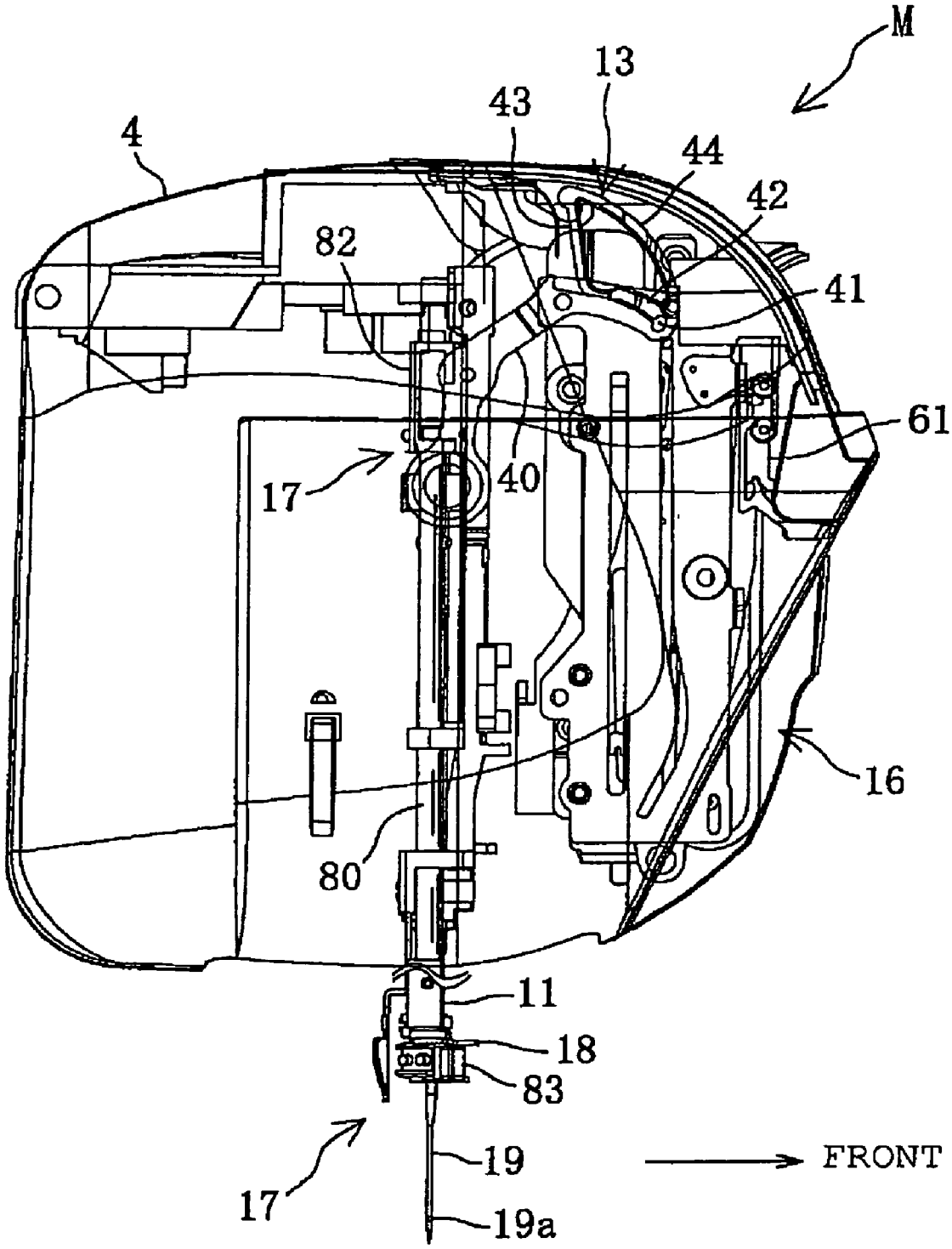
FIG. 5 is a perspective left side view of the sewing machine in an automatic threadable state.
Figure 6:
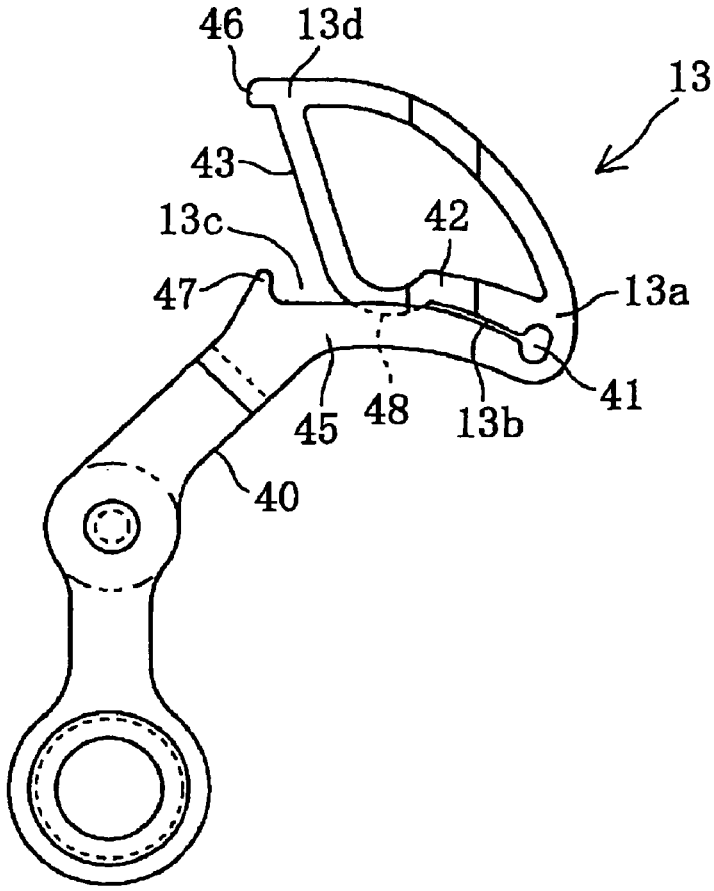
FIG. 6 is a left side view of a thread take-up lever.
Figure 7:
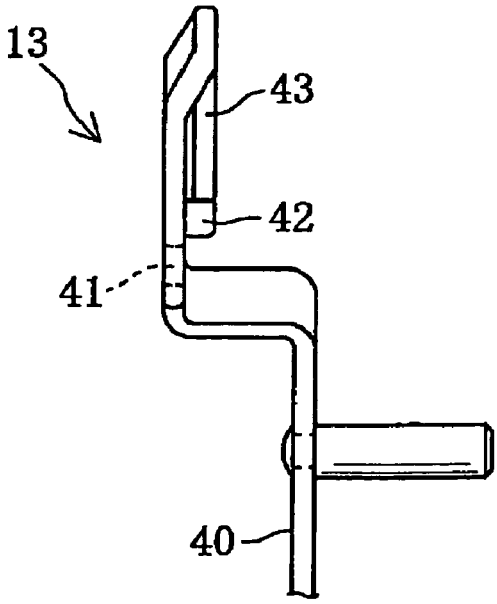
FIG. 7 is a front view of the thread take-up lever.
Figure 8:
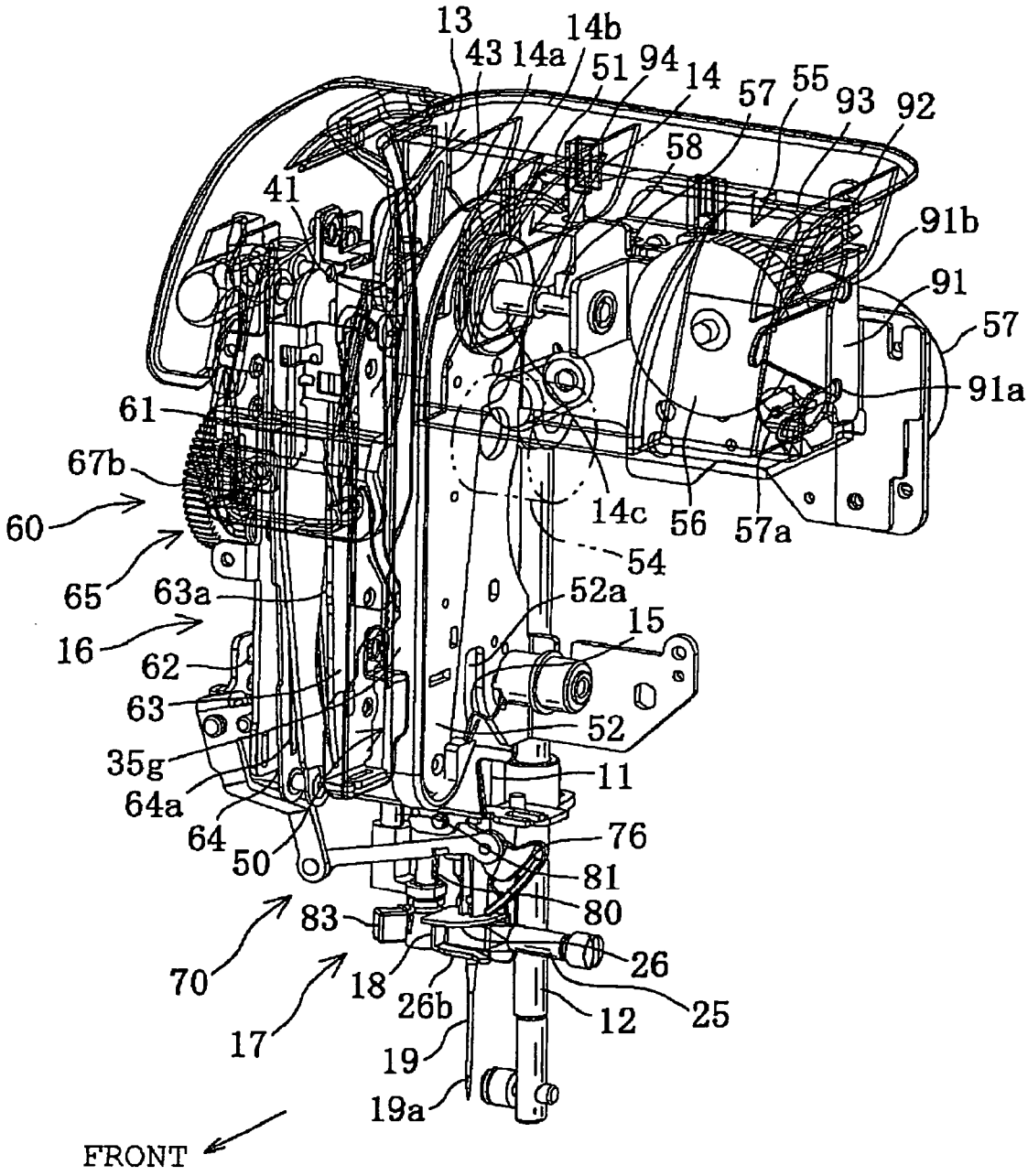
FIG. 8 is a perspective view of an automatic threader and an automatic needle threading mechanism as viewed over the upper right of the sewing machine.
Figure 9:
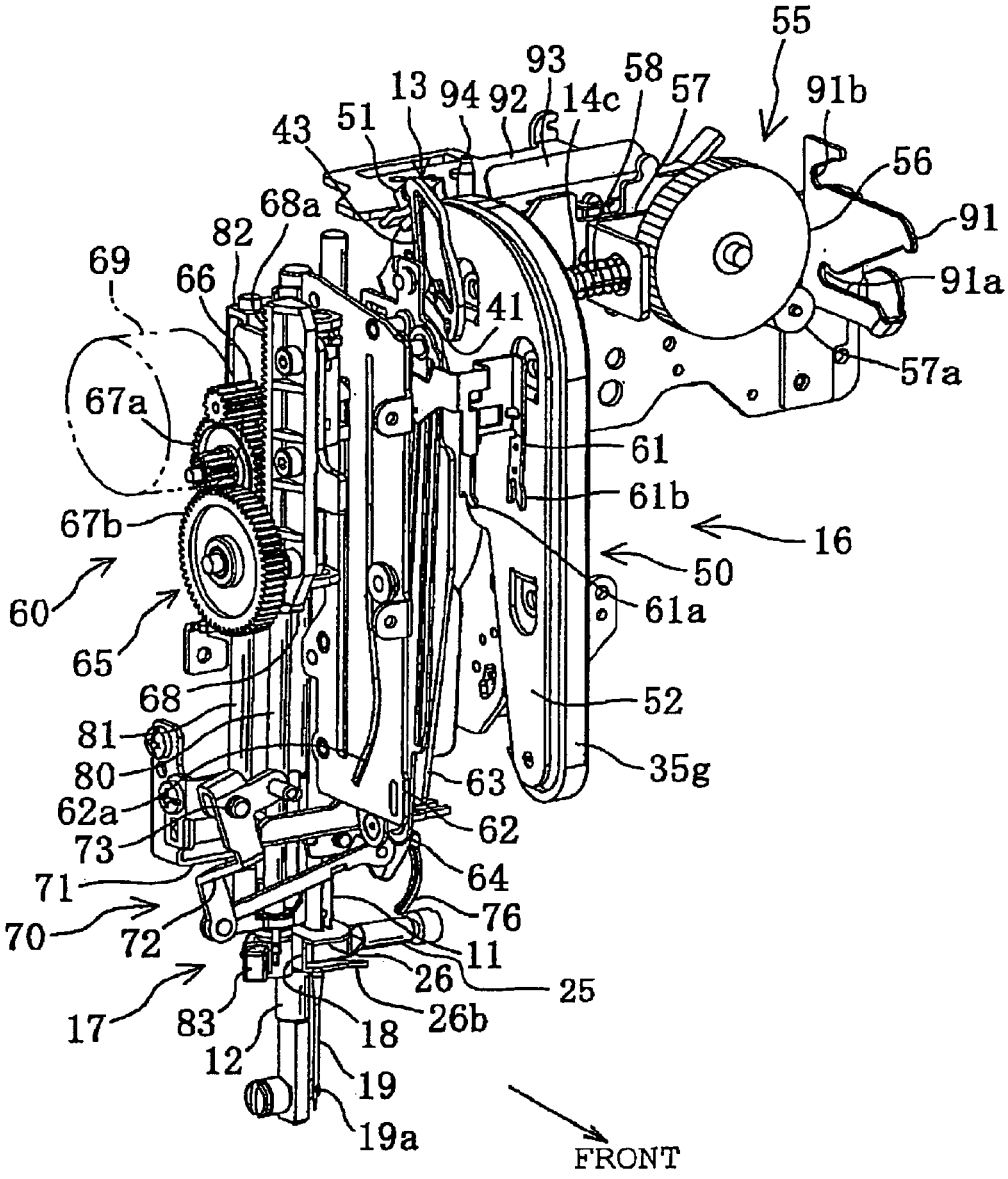
FIG. 9 is a perspective view of the automatic threader and the automatic needle threading mechanism as viewed over the upper left of the sewing machine.
Figure 10:
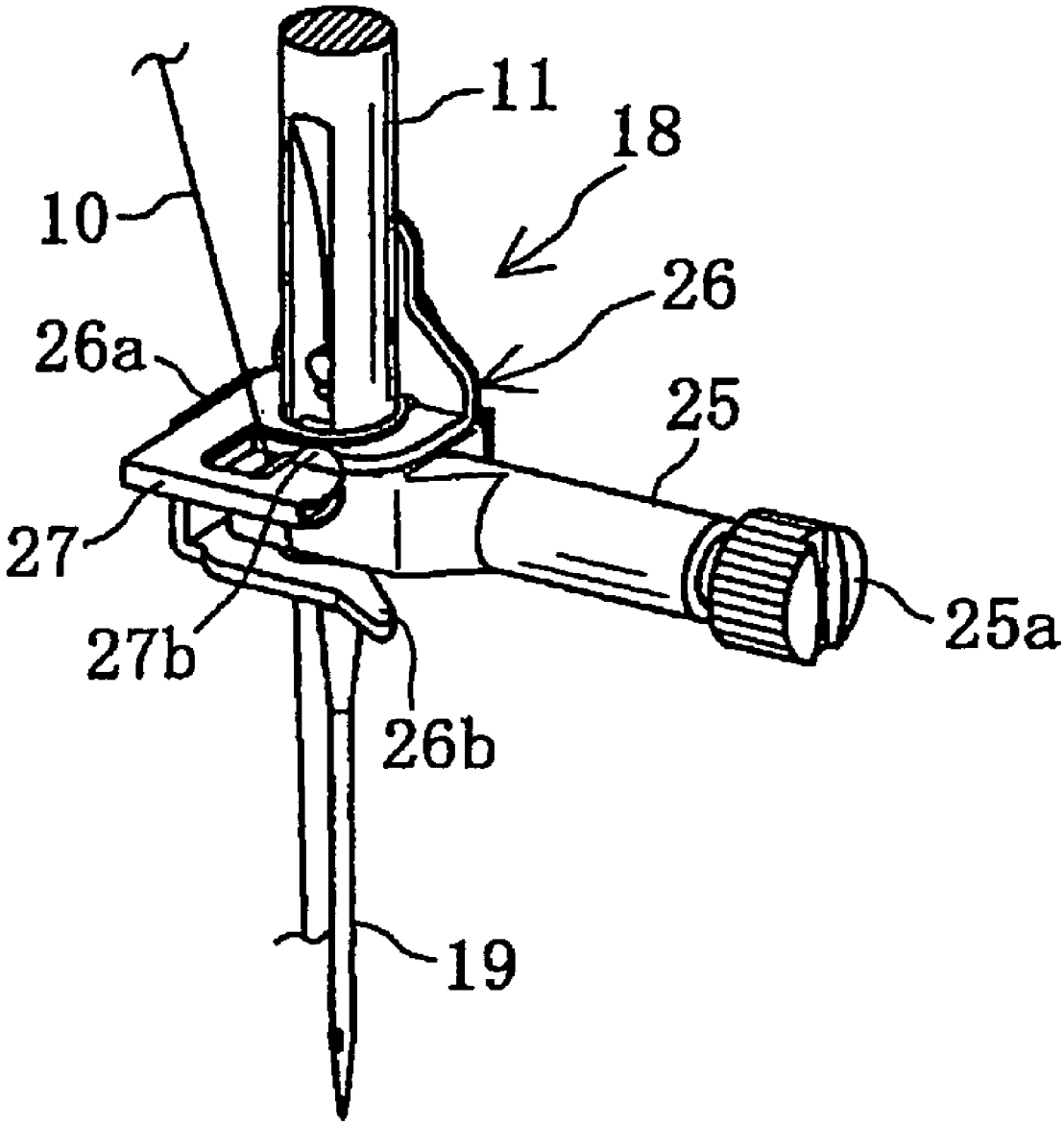
FIG. 10 is a perspective view of a needle connecting member and a needle bar thread guide.
Figure 11:
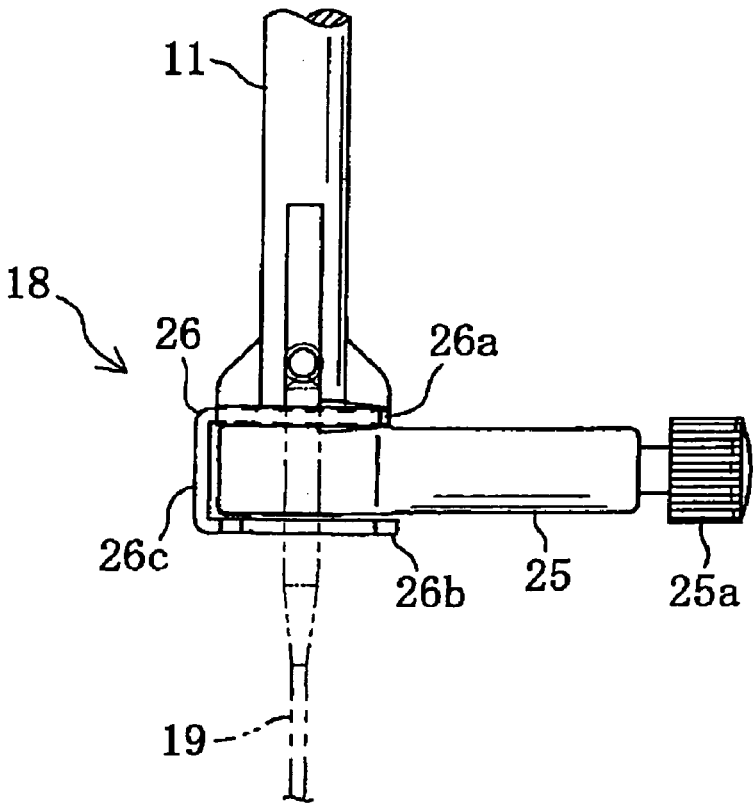
FIG. 11 is a front view of the needle connecting member and the needle bar thread guide.
Figure 12:
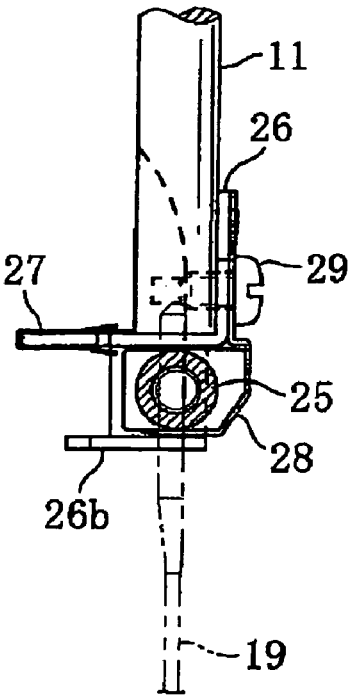
FIG. 12 is also a right side view of the needle connecting member and the needle bar thread guide.

Referring now to FIGS. 5 to 7, the thread take-up lever 13 is located in front of and over the needle bar 11. The thread take-up lever 13 has a proximal end serving as a lever body 40 as will be described later. The lever body 40 has a lower end mounted on the sewing machine frame so as to pivot about a horizontal axis. The thread take-up lever 13 is vertically swung in synchronization with the needle bar 11 by the sewing machine driving mechanism.

The thread tension regulator 14 has a pair of thread tension discs 14*a* and 14*b* and is disposed on the right of the thread take-up lever 13 or at the thread spool 9 side (upstream with respect to the thread take-up lever 13) so as to be directed right and left. The paired thread tension discs 14*a* and 14*b* are mounted via a horizontal thread tension shaft 14*c* to an upper end of a first guide frame 25 of the automatic threading device 16. The thread take-up spring 15 is mounted on a lower end of the first guide frame 25 located below the thread tension regulator 14 (upstream with respect to the thread take-up lever 13 and downstream with respect to the thread tension regulator 14). The thread take-up spring 15 is capable of elastically biasing the needle thread 10.

Referring to FIGS. 1 to 4, 8, 17A and 18A, the sewing machine M is provided with a thread preparation path 30 which automatically prepares the needle thread 10 drawn from the thread spool 9 to be set on a plurality of threaded portions (the thread tension regulator 14, the thread take-up spring 15, the thread take-up lever 13, the needle bar thread guide 18 and the like) by the automatic threading device 16 and further to be automatically passed through the thread eye 19*a* of the sewing needle 19 by the automatic needle threading mechanism 17. A thread introducing groove 31 is formed in a sewing machine cover 35 so as to be able to introduce the needle thread 10 into the thread preparation path 30.

The thread introducing groove 31 will now be described. Referring to FIGS. 1 to 4, the sewing machine cover 35 covering the upper portion of the arm 3 has a plurality of divided covers including an upper cover 35*a*, a thread introducing groove cover 35*b*, a rear cover 35*c*, a thread guide cover 35*d*, a front cover 35*e* covering a large part of a lower front of the arm 3, a large face plate 35*f* covering a large part of the head 4 and the like. The thread accommodating recess 7 is formed in the upper cover 35*a*. The upper cover 35*a* has a left end located in the center of the arm 3. An introducing groove 34*a* is formed between the upper cover 35*a* and the thread introducing groove cover 35*b* located on the left hand of the upper cover 35*a*. An introducing groove 34*b* is formed between the thread introducing groove cover 35*b* and the rear cover 35*c* located in the rear of the thread introducing groove cover 35*b*. A curved introducing groove 34*c* is formed between the thread guide cover 35*d*, and the thread introducing groove cover 35*b* and front cover 35*e*. A generally L-shaped introducing groove 34*d* is formed between the thread guide cover 35*d* and the face plate 35*f*. The introducing grooves 34*a*, 34*b* and 34*c* are serially connected to one another, and the introducing groove 34*d* extends from a lower end of the introducing groove 34*c*. The introducing grooves 34*a* to 34*d* constitute a thread introducing groove 31.

The thread take-up lever 13 will now be described in brief. The thread take-up lever 13 is formed into a generally gently angled shape in a side view and into the shape of a crank in a front view, as shown in FIGS. 5 to 7. The thread take-up lever 13 is vertically swung by the sewing machine driving mechanism (not shown). The thread take-up lever 13 includes a lever body 40, a lever threaded portion 41 which is formed integrally with the lever body 40 and on which the needle thread 10 is set so that sewing is executable. The thread take-up lever 13 further includes a lever thread introducing portion 42 introducing the needle thread 10 to the lever threaded portion 41 and an introduction guide portion 43 guiding the needle thread 10 to the lever thread introducing portion 42.

The lever threaded portion 41 is a small elliptic thread hole formed in the lever distal end 13*a* and communicates with an introduction guide portion 43 comprising a space defined between a thread receiving portion 45 extending from the lever body 40 to the lever distal end 13*a* and the lever thread introducing portion 42. The needle thread 10 is introduced through the thread introducing groove 13*b* to the lever threaded portion 41. The introduction guide portion 43 is comprised of a linear section which has substantially the same length as a distance from a thread introducing opening 13*c* which is an opening end of the thread introducing groove 13*b* to the lever thread introducing portion 42 and which makes an angle of about 120° with the thread receiving portion 45.

The introduction guide portion 43 has an end 13*d* formed with a first thread locking portion 46 which locks the needle thread 10 set on the introduction guide portion 43 so that the needle thread 10 can be prevented from being disengaged to the side opposed to the thread receiving portion 45. Furthermore, the thread receiving portion 45 has a proximal end formed with a second thread locking portion 47 which locks the needle thread 10 received by the thread receiving portion 45 so that the needle thread 10 can be prevented from being disengaged to the side opposed to the lever thread introducing portion 42.

A junction of the lever thread introducing portion 42 and the introduction guide portion 43 is formed with a protrusion 48 protruding toward the thread receiving portion 45. The protrusion 48 is formed so as to overlap the thread receiving portion 45. When the needle thread 10 has been introduced to the lever threaded portion 41, the protrusion 48 prevents the needle thread 10 from falling off through a gap between the thread receiving portion 45 and the lever thread introducing portion 42.

The sewing machine M is mechanically constructed and electrically arranged so that the needle thread 10 can be set on the thread preparation path 30 when the thread take-up lever 13 has been changed to a thread catch position in the vicinity of an upper limit position, as shown in FIG. 5. When the thread take-up lever 13 has not been located at the thread catch position, the automatic threading preparation switch 23 is operated so that the sewing machine motor 28 is driven to move the thread take-up lever 13 automatically to the thread catch position.

As shown in FIG. 5, when the thread take-up lever 13 has been changed to the thread catch position, the introduction guide portion 43 is inclined so as to make an angle of about 80° with a horizontal plane, whereby the introduction guide portion 43 is moved forward as the same goes downward. Furthermore, the lever thread introducing portion 42 is inclined so as to make an angle of about 20° with a horizontal plane, whereby the lever thread introducing portion 42 is moved forward as the same goes downward. The needle thread 10 located in the thread preparation path 30 is to be set on the introduction guide portion 43 from a rear thereof.

The automatic threading device 16 will now be described. Referring to FIGS. 8, 9, 17A to 17F, 18A to 18F and 19A to 19F, the automatic threading device 16 includes a first thread transferring mechanism 50 serving as a threader, a first stepping motor 50A for driving the first thread transferring mechanism 50, a second thread transferring mechanism 60 and a second stepping motor 69 for driving the second thread transferring mechanism 60. The first thread transferring mechanism 50 includes a first thread transferring member 54 (serving as a thread transferer) transferring the needle thread 10 previously set in the thread preparation path 30 to set the needle thread 10 on a plurality of the threaded portions (the thread tension regulator 14, the thread take-up spring 15, the thread take-up lever 13 and the like). The second thread transferring mechanism 60 includes a second thread transferring member 61 transferring to the sewing needle 19 the needle thread 10 located downstream with respect to the thread take-up lever 13. The first and second thread transferring mechanisms and the like constitute a thread transferring mechanism.

When transferred by the first thread transferring mechanism 50, the first thread transferring member 54 catches the needle thread 10 located upstream with respect to the introduction guide portion 43 of the thread take-up lever 13, transferring the needle thread 10 toward the thread take-up spring 15. During the thread transfer, the needle thread 10 is set on the thread tension regulator 14 so that the thread tension regulator 14 is threaded. At a final stage of the thread transfer, the needle thread 10 is set on the thread take-up spring 15 so that the thread take-up spring 15 is threaded. In cooperation of the first and second thread transferring members 54 and 61, the needle thread 10 is set on the lever threaded portion 41 during the thread transfer so that the lever threaded portion 41 is threaded.

The first thread transferring mechanism 50 includes a first guide frame 52, a first thread transferring member 51 and a first driving mechanism (not shown) moving the first thread transferring member 51. The first thread transferring member 51 is constructed so as to be vertically movable between a first standby position as shown in FIGS. 17A, 18A and 19A and a thread passing position as shown in FIGS. 17D and 18D.

The first guide frame 52 is fixed on the right of the needle bar 11 and the thread take-up lever 13 so as to assume a vertical position and is a vertically long plate-like frame with sides thereof being directed in the right-and-left directions. The first guide frame 52 has an upper edge which has a larger diameter and is formed into an arc shape, a front edge formed into a vertically long linear shape and a lower edge which has a smaller diameter and is formed into an arc shape.

The thread tension discs 14*a* and 14*b* of the thread tension regulator 14 are mounted via a thread tension shaft 14*c* to an upper end of a right side of the first guide frame 52. The thread take-up spring 15 biased by a spring (not shown) is mounted to a lower end of the first guide frame 52. A notch 52*a* is formed in a lower part of the first guide frame 25 so as to be depressed upward from the lower end of the frame. The thread take-up spring 15 faces the notch 52*a*, whereupon the thread take-up spring 15 sufficiently exhibits a thread catching function for the needle thread 10 the thread take-up spring 15 engages through the notch 25*a* from below.

Figure 17A:
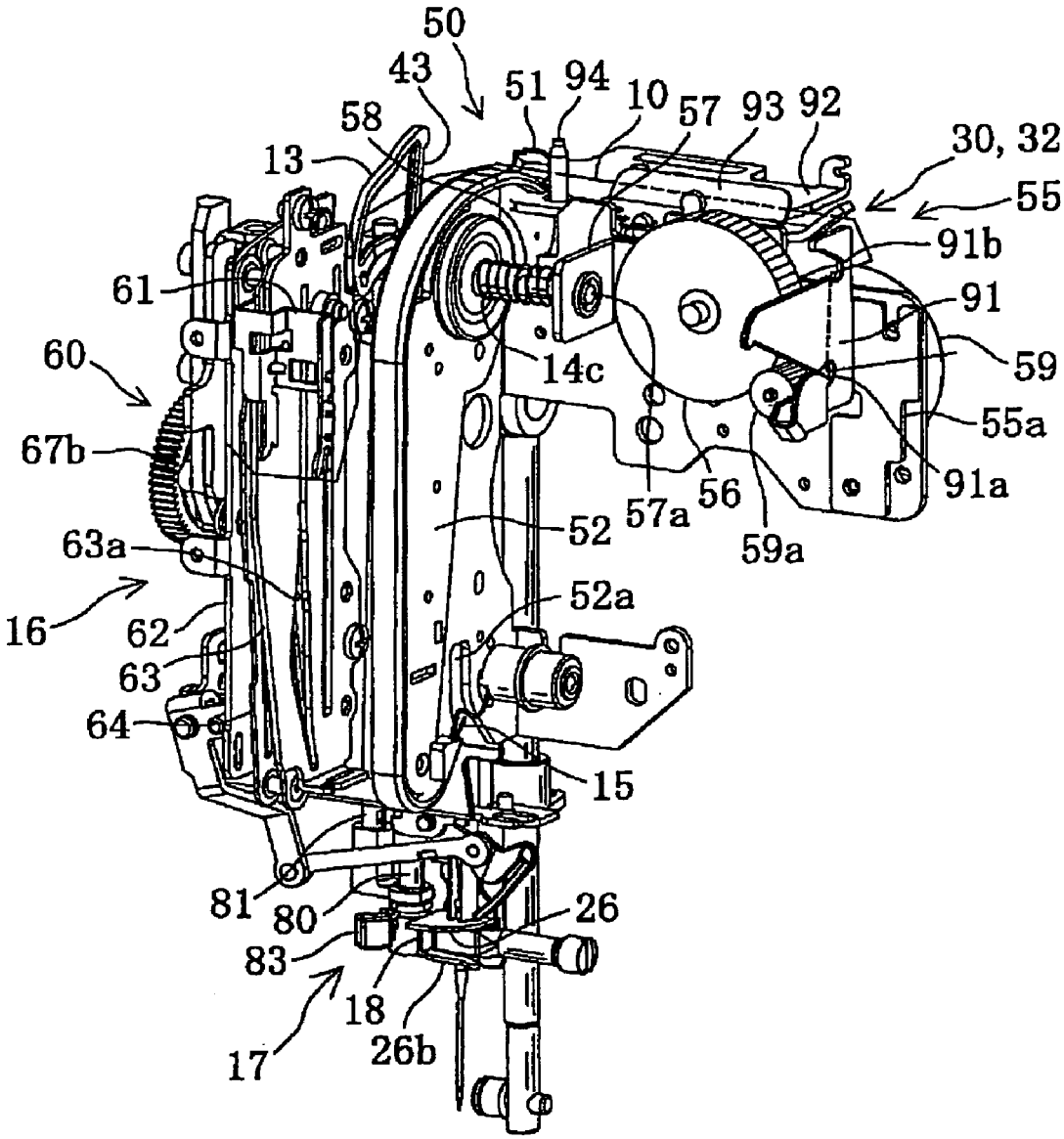
FIG. 17A is a perspective view of the automatic threader and the automatic needle threading mechanism in a standby state.
Figure 17B:
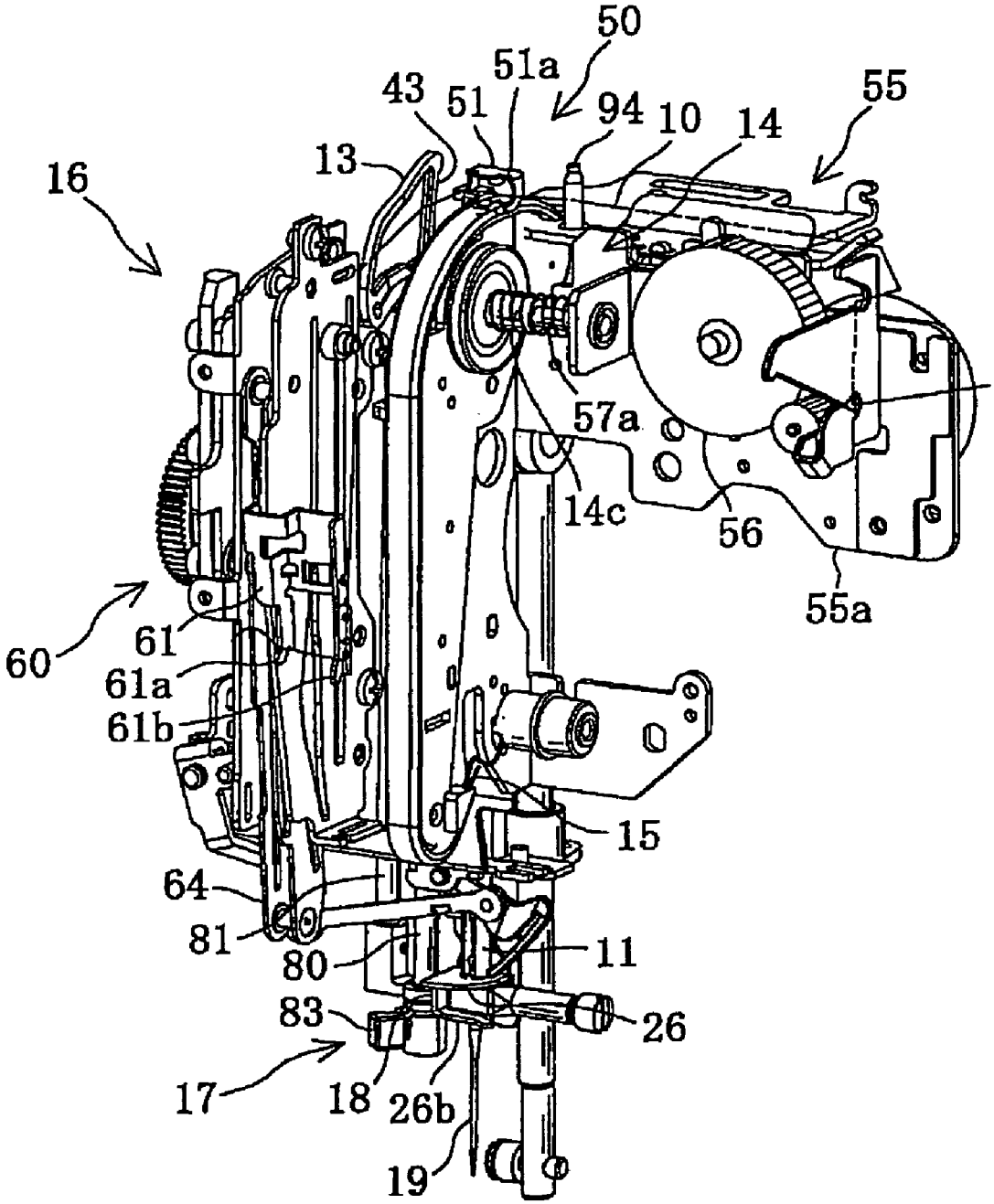
FIG. 17B is a perspective view of the automatic threader and the automatic needle threading mechanism in a condition where the sewing machine has been threaded.
Figure 17D:
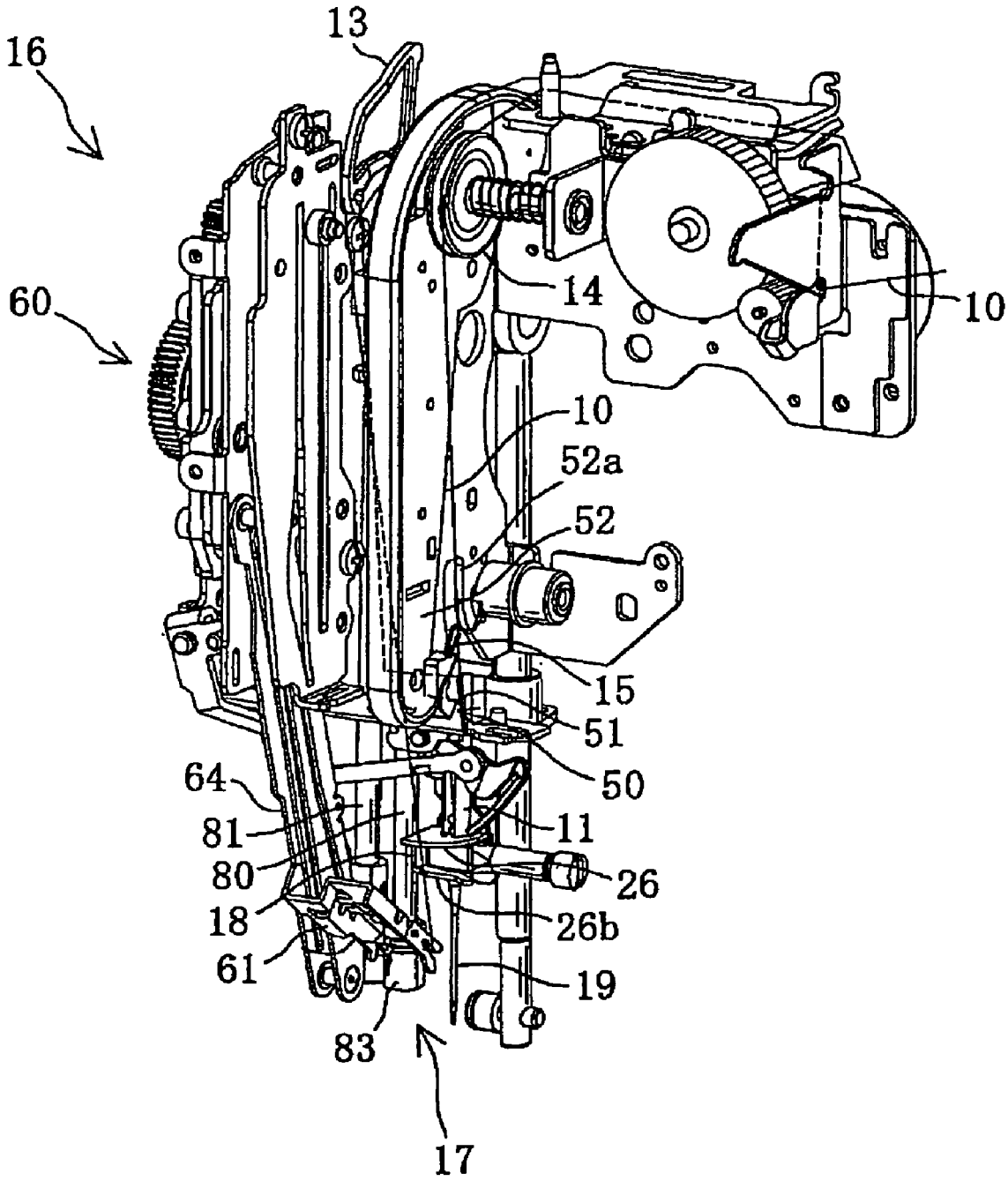
FIG. 17D is a perspective view of the automatic threader and the automatic needle threading mechanism in a condition where the thread take-up spring has been threaded.
Figure 18A:
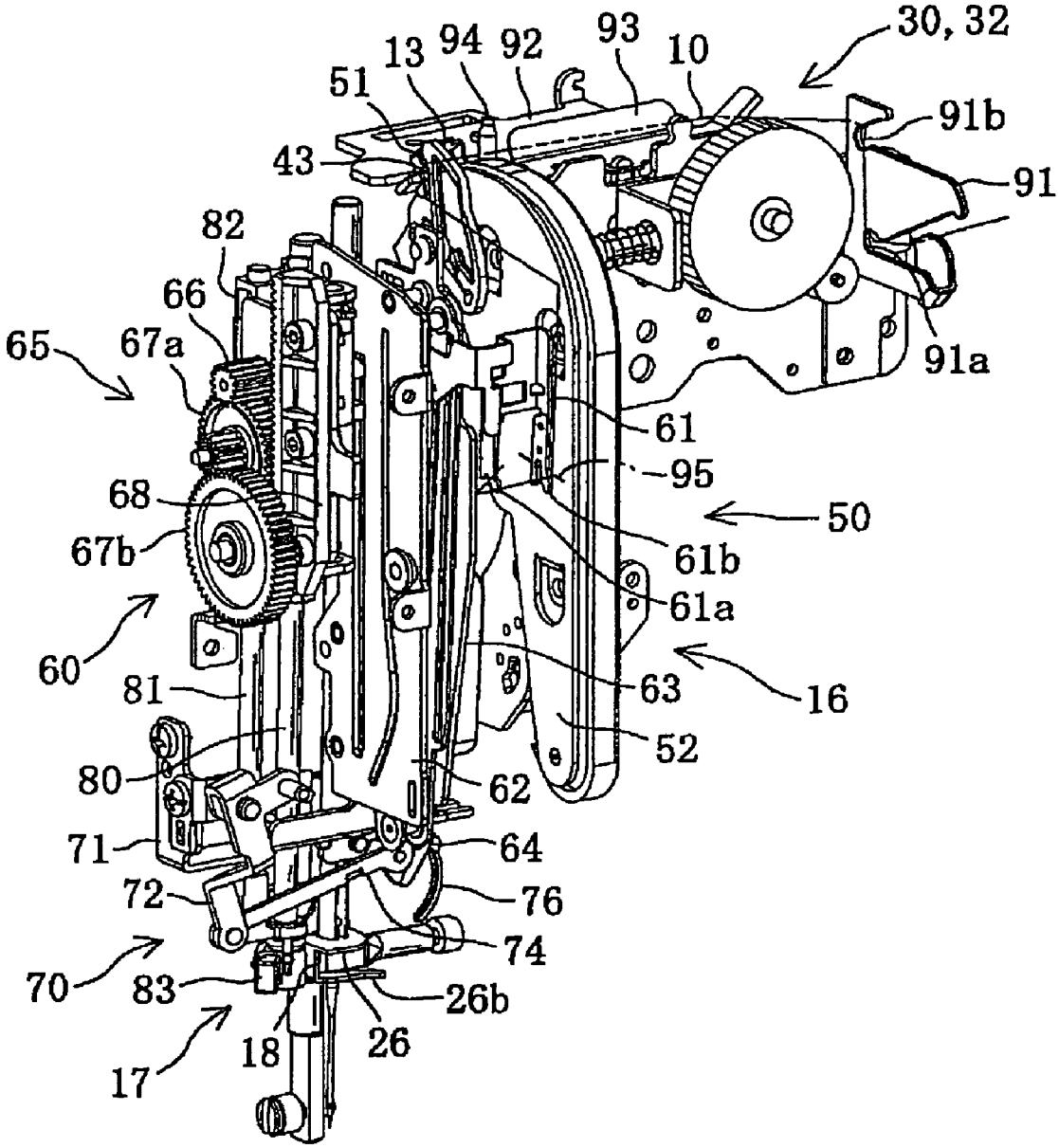
FIG. 18A is a perspective view of the automatic threader and the automatic needle threading mechanism in a standby state.
Figure 18B:
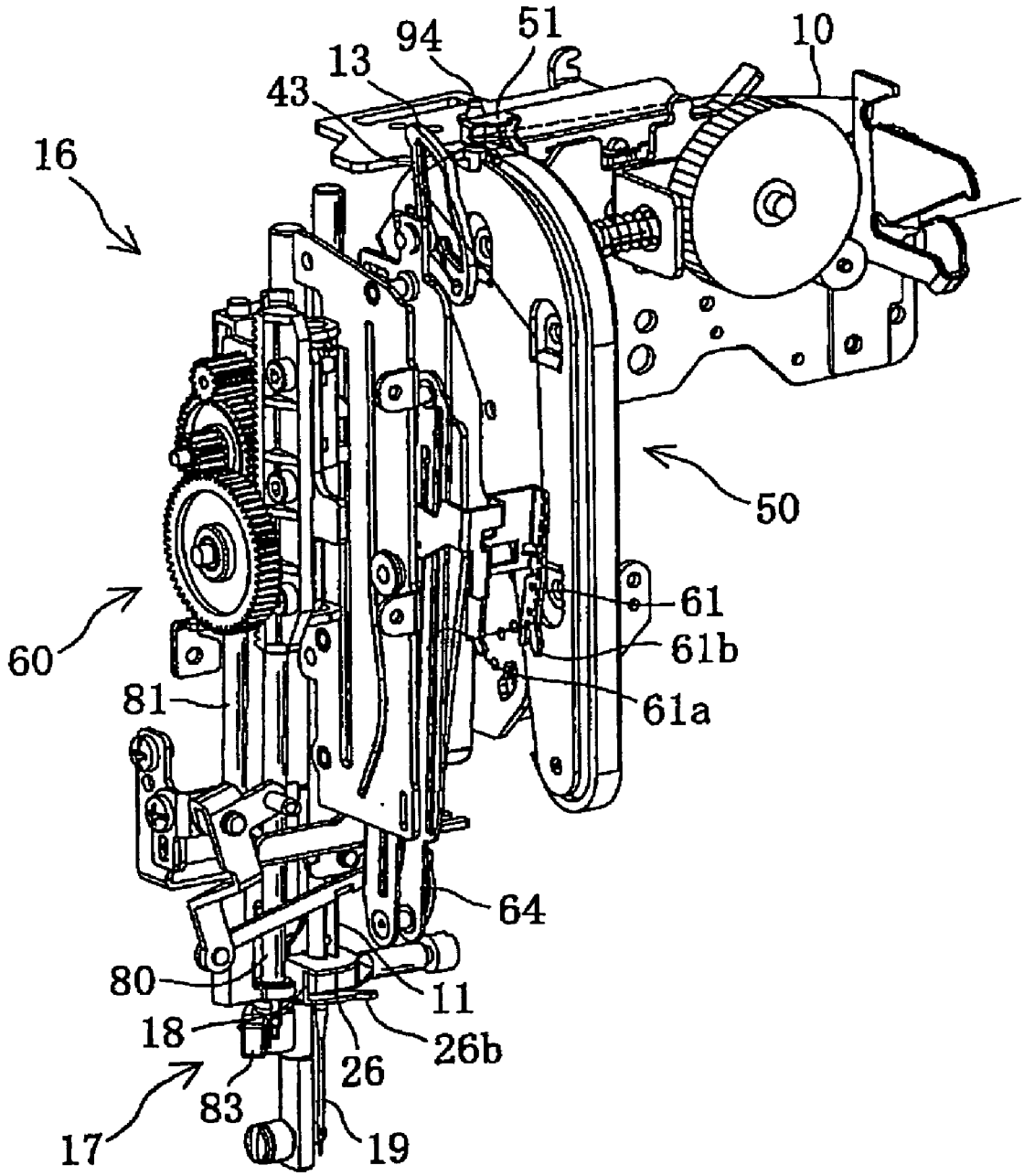
FIG. 18B is a perspective view of the automatic threader and the automatic needle threading mechanism in a condition where the sewing machine has been threaded.
Figure 18D:
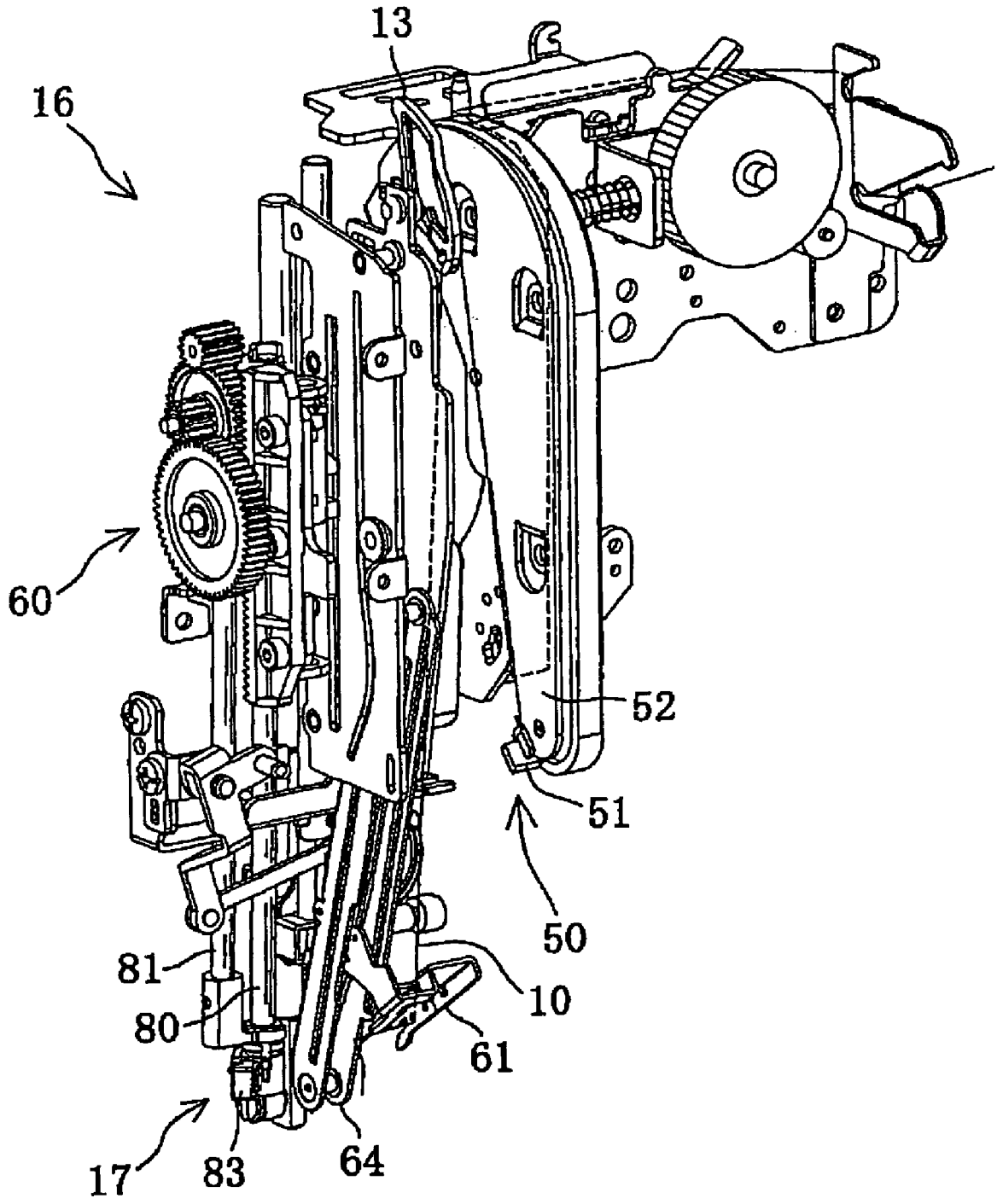
FIG. 18D is a perspective view of the automatic threader and the automatic needle threading mechanism in a condition where the thread take-up spring has been threaded.
Figure 19A:
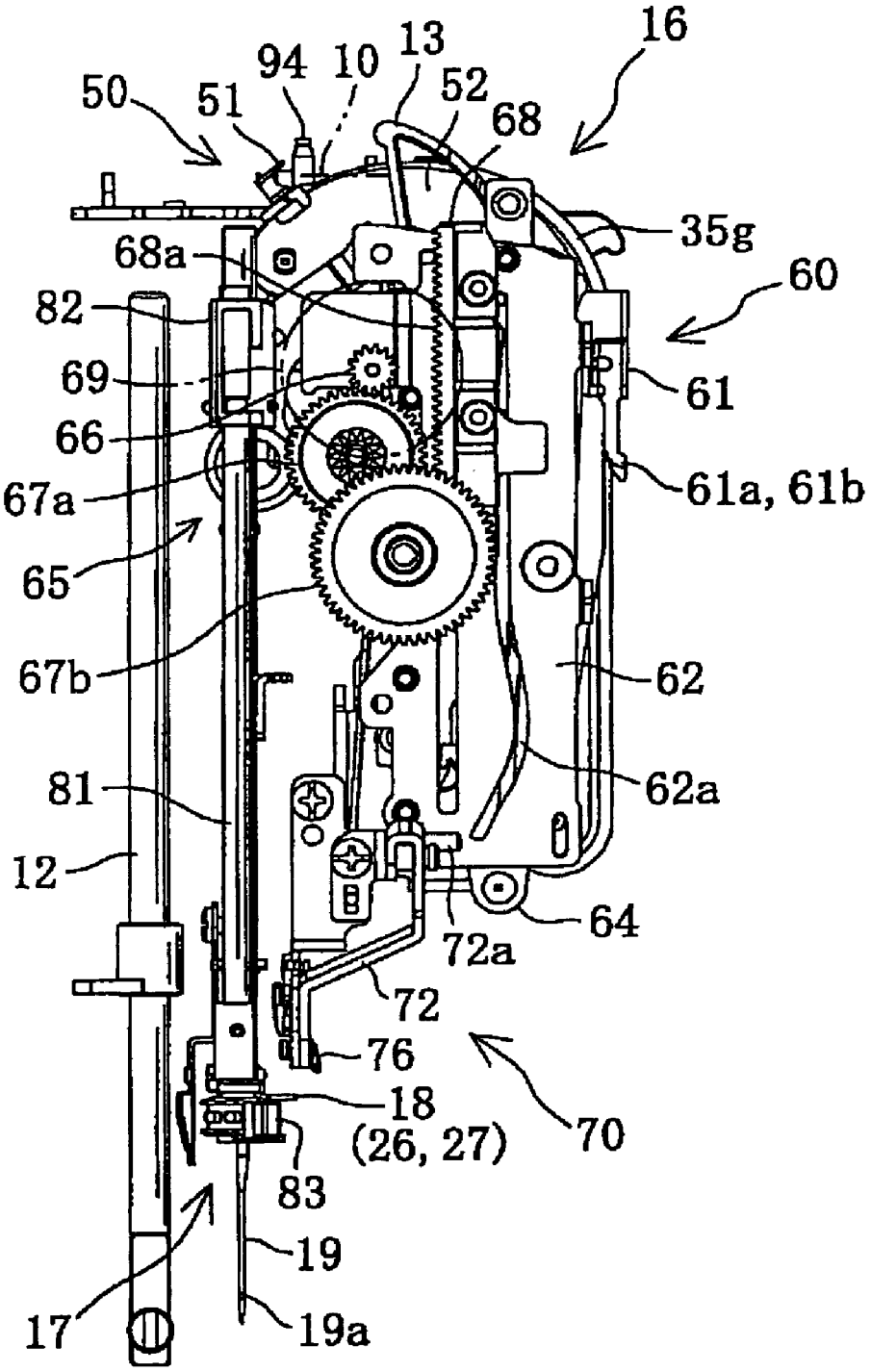
FIG. 19A is a perspective view of the automatic threader and the automatic needle threading mechanism in a standby state.
Figure 19B:
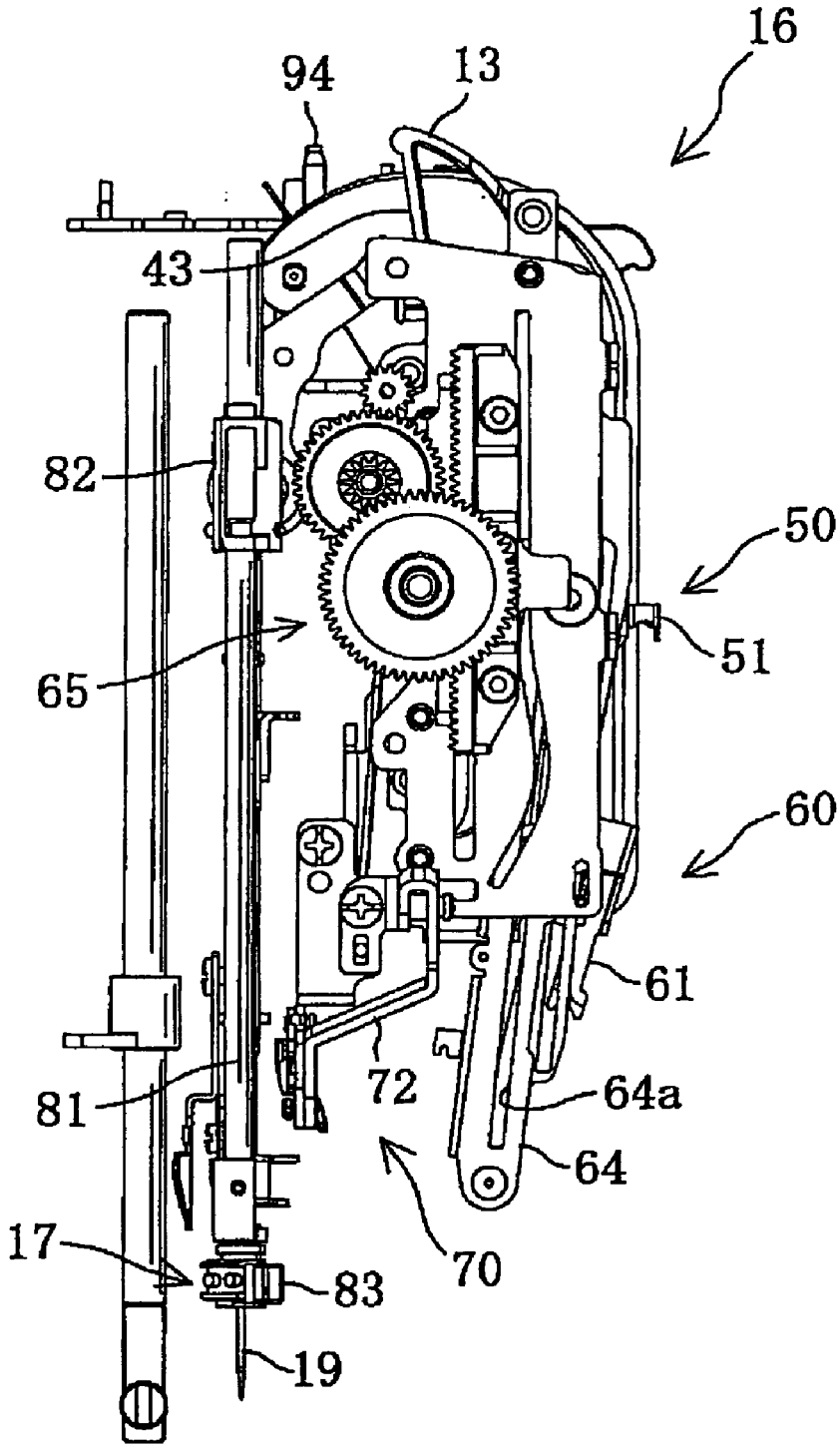
FIG. 19B is a perspective view of the automatic threader and the automatic needle threading mechanism in a condition where the sewing machine has been threaded.

The standby position of the first thread transferring member 51 is a movement start position of an upper end and a rear of the first guide frame 52, as shown in FIGS. 17A, 18A and 19A. The thread passing position of the first thread transferring member 51 is a movement end position of a lower end and the rear of the first guide frame 52, as shown in FIGS. 17D, 18D and 19D. Accordingly, the first thread transferring member 51 is moved downward at a stroke along the upper, front and lower edges of the first guide frame 52 from the upper standby position to the lower thread passing position. The first thread transferring member 51 is formed with a thread hook 51*a* forwardly protruding at the standby position and a leg supporting the thread hook 51*a*. The first thread transferring member 51 is supported by the engagement of the leg with the edge of the guide frame 52 so as to be movable from the standby position to the thread passing position.

When moved from the standby position to the thread passing position, the first thread transferring member 51 transfers the needle thread 10 downward while a part of the needle thread 10 previously set on the thread preparation path 30 is caught by the thread hook 51*a* during the downward movement. Accordingly, the needle thread 10 is set on the thread tension regulator 14 located upstream with respect to the first thread transferring member 51. When the first thread transferring member 51 has reached the lower thread passing position, the downward movement thereof is stopped.

Thus, when the first thread transferring member 51 reaches the thread passing position and the thread transfer is stopped, the needle thread 10 caught by the thread hook 51*a* is located beneath the thread take-up spring 15. Since a second thread transferring member 61 which will be described later is continuously moved downward subsequently, the needle thread 10 is pulled to the second thread transferring member 61 side as the result of movement of the second thread transferring member 61. Consequently, the needle thread 10 is disengaged from the thread hook 51*a* thereby to be introduced into the notch 52*a* from the lower end, whereupon the needle thread 10 is reliably set on the thread take-up spring 15.

The first driving mechanism includes an endless timing belt to which the first thread transferring member 51 is coupled and a guide groove (not shown) guiding the timing belt along the upper, front and lower edges of the first guide frame 52. When the timing belt is driven by the first stepping motor 54 (see FIG. 8), the first thread transferring member 51 is moved between the standby position and the thread passing position by the timing belt.

A thread tension regulating mechanism 55 including the thread tension regulator 14 will now be described with reference to FIGS. 17A to 17C. The thread tension regulating mechanism 55 includes a pair of thread tension discs 14*a* and 14*b* pinching the needle thread 10 therebetween so that a tension is applied to the needle thread 10, a compression coil spring 58 pressing the movable thread tension disc 14*b* against the fixed thread tension disc 14*a*, a tension adjusting mechanism adjusting a spring force of the compression coil spring 58 and a thread tension stepping motor 59 operating the tension adjusting mechanism.

Describing the tension adjusting mechanism, a rightward directed mounting plate 55*a* is secured to an upper end of the first guide frame 52. A pivot shaft is fixed to the mounting plate 55*a*. A circular tension adjusting gear 56 is rotatably mounted on the pivot shaft. A circular arc cam (not shown) constituting a part of a helicoid is formed in a rear surface of the tension adjusting gear 56. An L-shaped thread tension plate 57 has a right end engaging the arc cam. A leftward directed spring receiving pin 57*a* is secured to the thread tension plate 57. The spring receiving pin 57*a* has a distal end (left end) partially fitted in a hollow interior of a thread tension shaft 14*c* secured to the first guide frame 52. A compression coil spring 58 is interposed between the thread tension disc 14*b* and the thread tension bracket 57.

Therefore, when the thread tension stepping motor 59 is driven, the tension adjusting gear 56 is rotated via the driving gear 59*a* and the thread tension bracket 57 engaging the circular-arc cam is moved right and left. As the thread tension bracket 57 is moved farther rightward, the spring force of the compression coil spring 58 is reduced and the tension of the thread tension regulator 14 is accordingly reduced eventually to zero. On the other hand, as the thread tension bracket 57 is moved farther leftward, the spring force of the compression coil spring 58 is increased and the tension of the thread tension regulator 14 is accordingly increased.

Figure 17E:
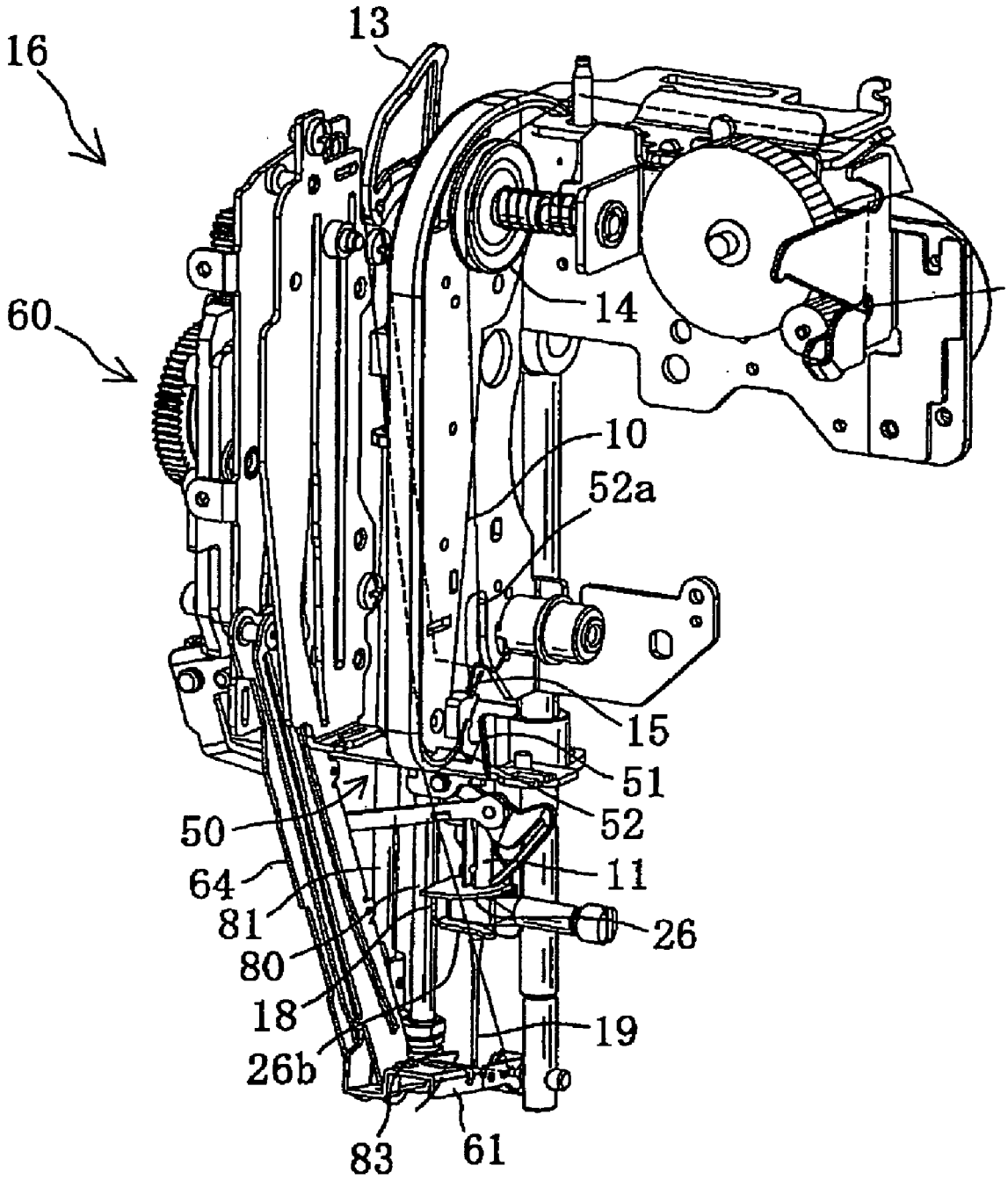
FIG. 17E is a perspective view of the automatic threader and the automatic needle threading mechanism in a condition where the needle thread assumes the thread passing position.
Figure 17F:
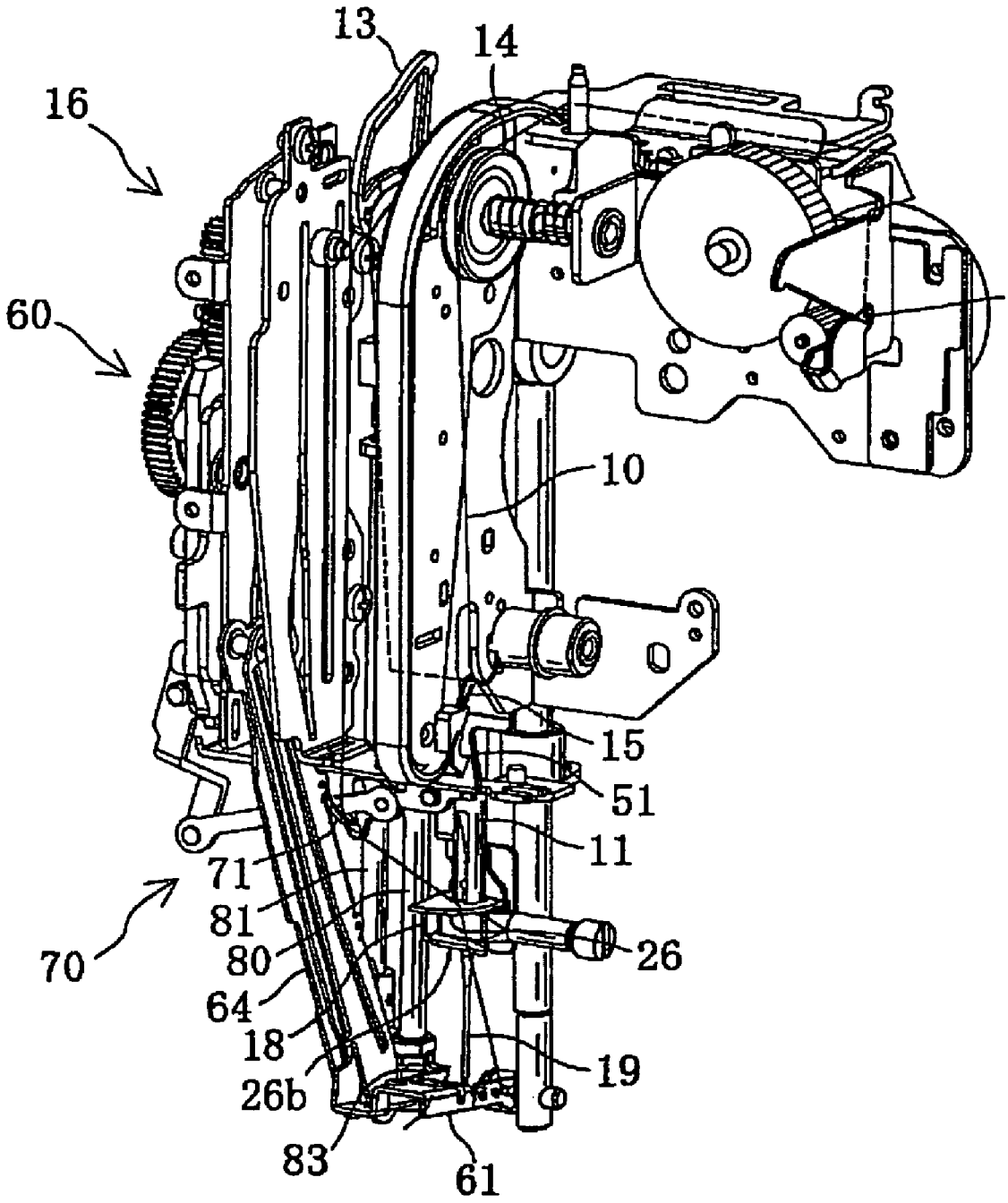
FIG. 17F is a perspective view of the automatic threader and the automatic needle threading mechanism in a condition where a needle bar has been threaded.

The second thread transferring mechanism 60 comprises a pair of right and left second guide frames 62 and 63 fixed in parallel to the sewing machine frame, a moveable frame 64 guided and supported by the second guide frames 62 and 63, a second thread transferring member 61 guided and supported by the moveable frame 64 and a second driving mechanism 65 driving the moveable frame 64 and the second thread transferring member 61. The moveable frame 64 is moveable between a retracted position as shown in FIGS. 17A, 18A and 19A and a protruding position as shown in FIGS. 17E, 18E and 19E. The second thread transferring member 61 is guided and supported by the moveable frame 64 and is moveable between a stand-by position as shown in FIGS. 17A, 18A and 19A and a thread transfer position as shown in FIGS. 17E, 18E and 19E with the movement of the moveable frame 64.

The second guide frames 62 and 63 are disposed on the left of the needle bar 12 and thread take-up lever 13 and is a vertically long plate-like frame with sides thereof being directed in the right-and-left directions. The second guide frames 62 and 63 are spaced away from each other so as to face each other. The moveable frame 64 is provided between the guide frames 62 and 63 so as to be protrudable and retractable. The moveable frame 64 is structured by a pair of right and left slender moveable pieces connected together. The second thread transferring member 61 is moveably supported on the moveable frame 64 via its support section (not shown).

The second thread transferring member 61, when assuming the standby position, is directed downward at a position just in front of and below the thread take-up lever 13 moved to the thread hooking position, as shown in FIGS. 17A, 18A and 19A. Furthermore, the second thread transferring member 61, when assuming the thread passing position, is located in front of the sewing needle 19 and directed backward, as shown in FIGS. 17E, 18E and 19E. The second transferring member 61 has a pair of thread retainers 61*a* and 61*b* capable of retaining the needle thread 10 in the thread preparation path. The thread retainers 61*a* and 61*b* are bifurcated so as to be able to hold the needle thread 10. However, the left-hand thread retainer 61*a* is configured to sandwich the needle thread 10 in cooperation with a discrete thread nipping piece which is not shown.

When the second thread transferring member 61 is moved downward from the standby position to the thread passing position, the needle thread 10 set on the thread preparation path 30 is retained by the right thread retainer 61*b* and nipped by the left thread retainer 61*a*. When the second thread transferring member 61 is moved to the lower thread passing position, the needle thread 10 retained between the thread retainers 61*a* and 61*b* is located just in front of the thread eye 19*a* of the needle 19 and on standby in a tensioned state.

The second driving mechanism 65 includes a driving gear 66, double gears 67*a* and 67*b* and a rack forming member 68. The gears 66, 67*a* and 67*b*, rack forming member 68 and the second stepping motor 69 are disposed on the left-hand side of the second guide frame 62. The second stepping motor 69 is fixed to the sewing machine frame and has an output shaft to which the driving gear 66 is connected. The rack forming member 68 serves as a moveable member moved upward and downward in the second driving mechanism 65. The double gears 67*a* and 67*b* are rotatably mounted on the sewing machine frame. An output gear 66 is in mesh engagement with a larger-diameter gear of the double gear 67*a*. The double gear 67*a* has a smaller-diameter gear in mesh engagement with a larger-diameter gear of the double gear 67*b*. The rack forming member 68 is guided so as to be moveable upward and downward along the second guide frames 62 and 63. The rack forming member 68 has a rack 68*a* in mesh engagement with a smaller-diameter gear of the double gear 67*b*.

Upon drive of the second stepping motor 69, a driving force is transmitted via the double gears 67*a* and 67*b* and rack 68*a* to the rack forming member 68, so that the rack forming member 68 is moved downward. When the rack forming member 68 is moved downward, the moveable frame 64 connected via a plurality of pulleys and a wire (neither shown) to the rack forming member 68 is moved downward at a speed about twice as high as that of the rack forming member 68 and the second thread transferring member 61 connected via a plurality of pulleys and a wire (neither shown) to the rack forming member 68 is moved downward at a speed about twice as high as that of the moveable frame 64 (that is, at a speed about four times as high as that of the rack forming member 68).

Next, a thread guide threading mechanism 70 will be described which captures the needle thread 10 extending from the thread take-up lever 13 to the thread retainer 61*b* on the right-hand side of the second thread transferring member 61 with a thread hook 76 and sets the needle thread 10 on the needle bar thread guide 18 on the lower end of the needle bar 11. The threading hook 76 of the thread guide threading mechanism 70 is swingable from the standby position to the thread passing position just in front of the needle bar thread guide 18, so as to avoid interference with the second thread transferring member 61 assuming the standby position.

A laterally extending horizontal generally L-shaped support plate 71 is secured to rear lower ends of the second guide frames 62 and 63, as shown in FIGS. 9, 18A, 19A, 20A, 20B and 21. The L-shaped support plate 71 has a left end on which a first pivot pin 73 is mounted. A crank-shaped first link 72 has an upper end which is pivotally mounted on the pivot pin 73. The first link 72 has a lower end on which a second pivot pin 75 is mounted. A second link 74 has a left end which is pivotally mounted on the second pivot pin 75. The second link 74 has a right-hand end on which a third pivot pin 77 is mounted. A threading hook 76 has a lengthwise central portion which is pivotally mounted on the third pivot pin 77. The L-shaped support plate 71 has an underside to which a pivotal support member 78 is mounted. A fourth pivot pin 79 is mounted on the pivotal support member 78. The threading hook 76 has a proximal end pivotally mounted on the fourth pivot pin 79. As a result, the first and second links 72 and 74 and the thread hook 76 are swingable in parallel to a vertical surface.

Figure 21:
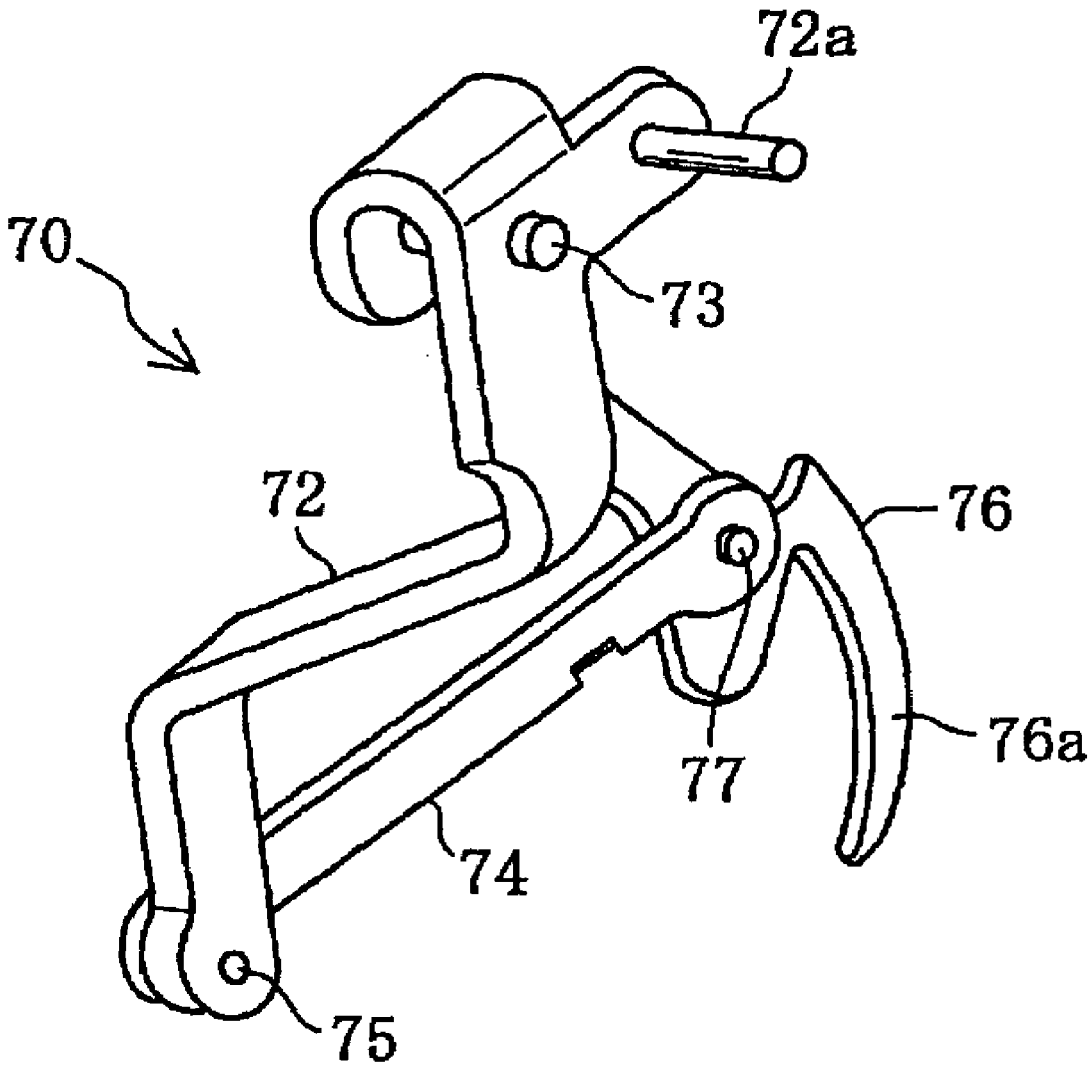
FIG. 21 is an enlarged perspective view of a threading hook.
Figure 22A:
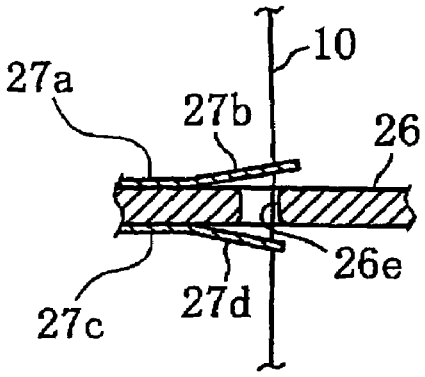
FIG. 22A is a view similar to FIG. 14, showing the condition immediately before the needle bar thread guide is threaded.
Figure 22B:
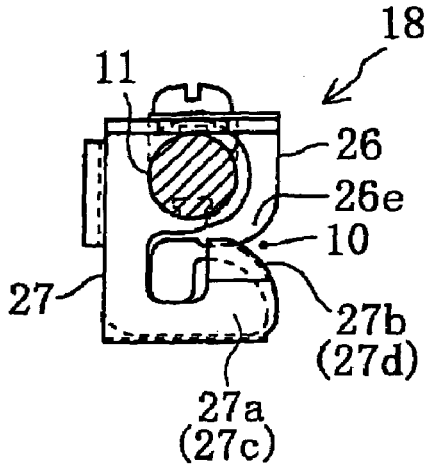
FIG. 22B is a view similar to FIG. 13, showing the condition immediately before the needle bar thread guide is threaded.
Figure 22C:
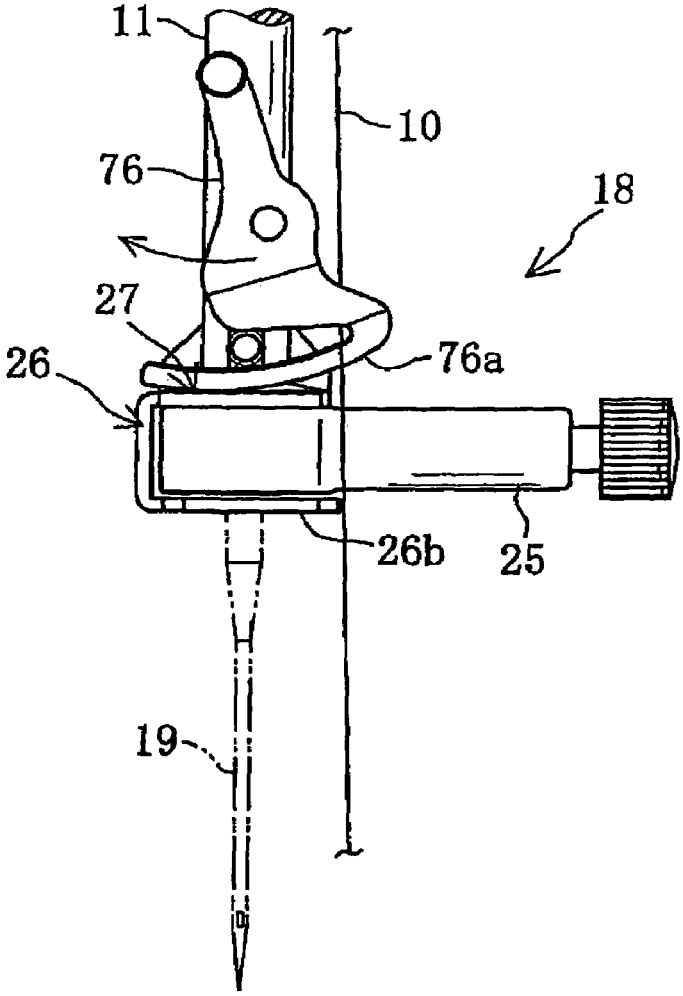
FIG. 22C is a view similar to FIG. 11, showing the condition immediately before the needle bar thread guide is threaded.

The threading hook 76 has a distal end formed with a curved sickle-like (arc) hook 76*a* having a predetermined length. The hook 76*a* is formed so that a distal end thereof protrudes frontward as shown in FIG. 21. The needle thread 10 is transferred just in front of the needle bar thread guide 18 to the needle bar thread guide 18 side in an inclined state. The inclined needle thread 10 is retained in a swinging locus of the hook 76*a*. Consequently, when the threading hook 76*a* is swung, the inclined needle thread 10 is easily caught on the hook 76*a* and moreover, the hooked needle thread 10 is adapted to be pulled toward the needle bar thread guide 18.

Figure 20A:
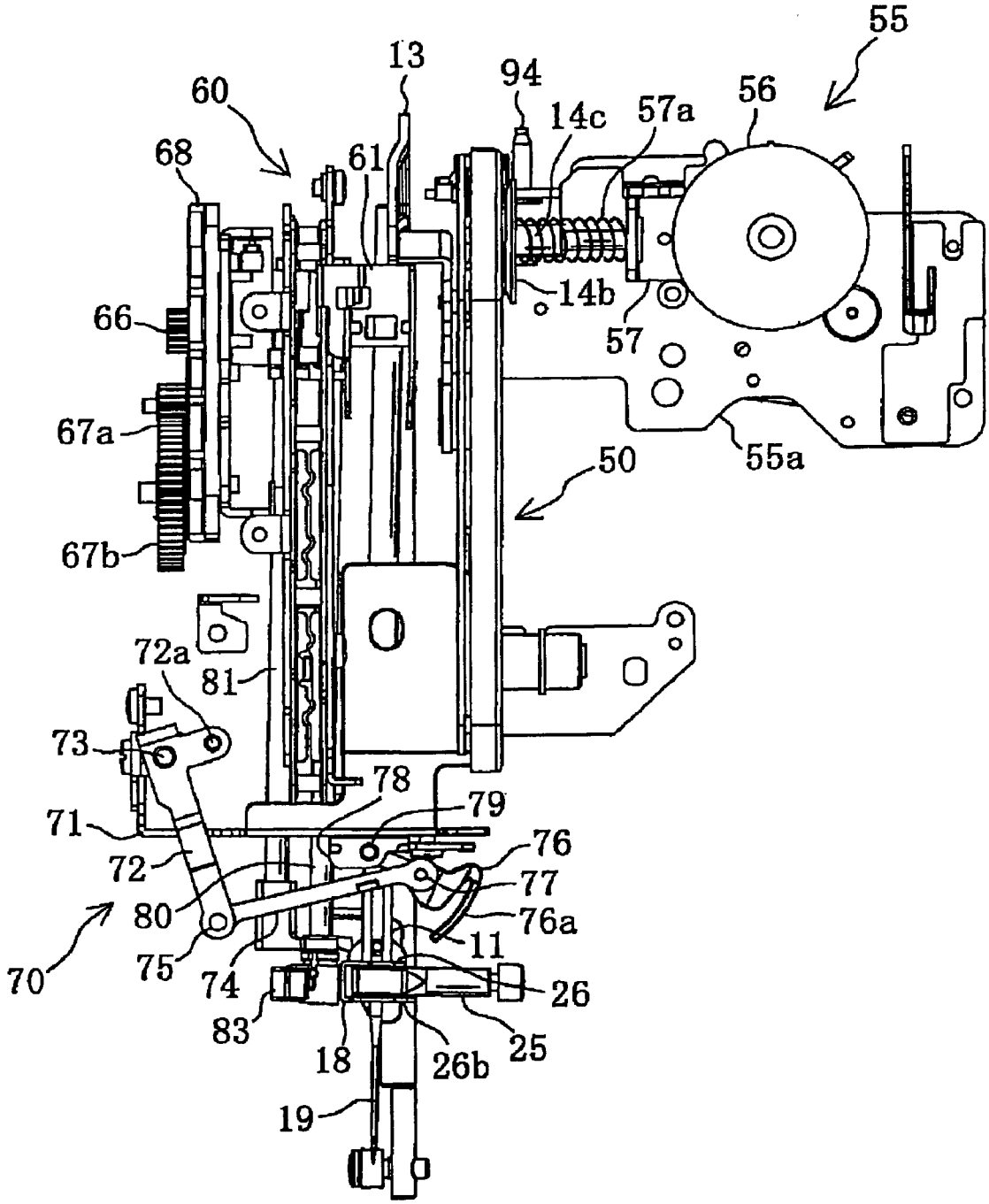
FIG. 20A is a perspective view of the automatic threader and the automatic needle threading mechanism in a standby state.
Figure 20B:
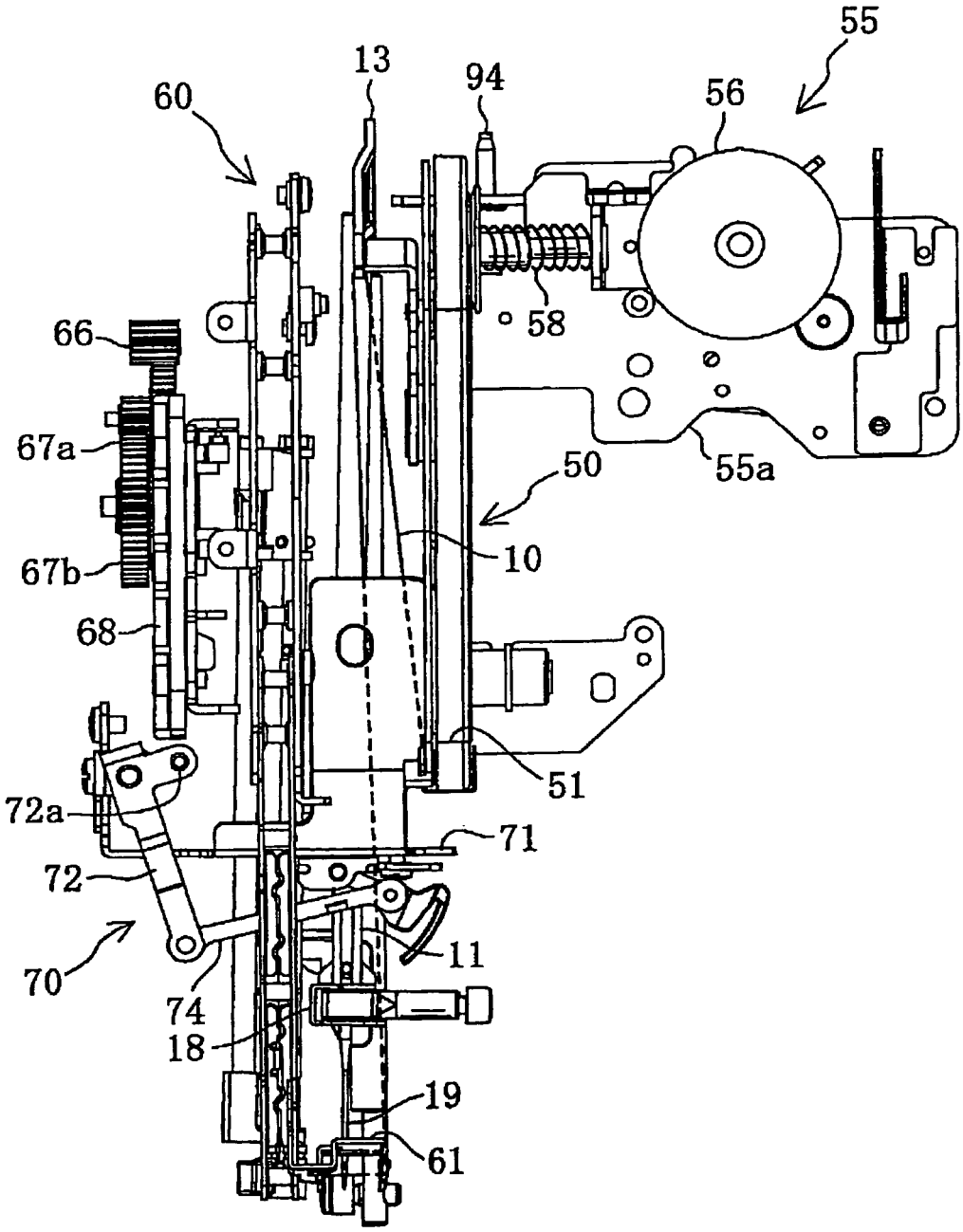
FIG. 20B is a perspective view of the automatic threader and the automatic needle threading mechanism in a condition where the needle thread assumes the thread passing position.
Figure 20C:
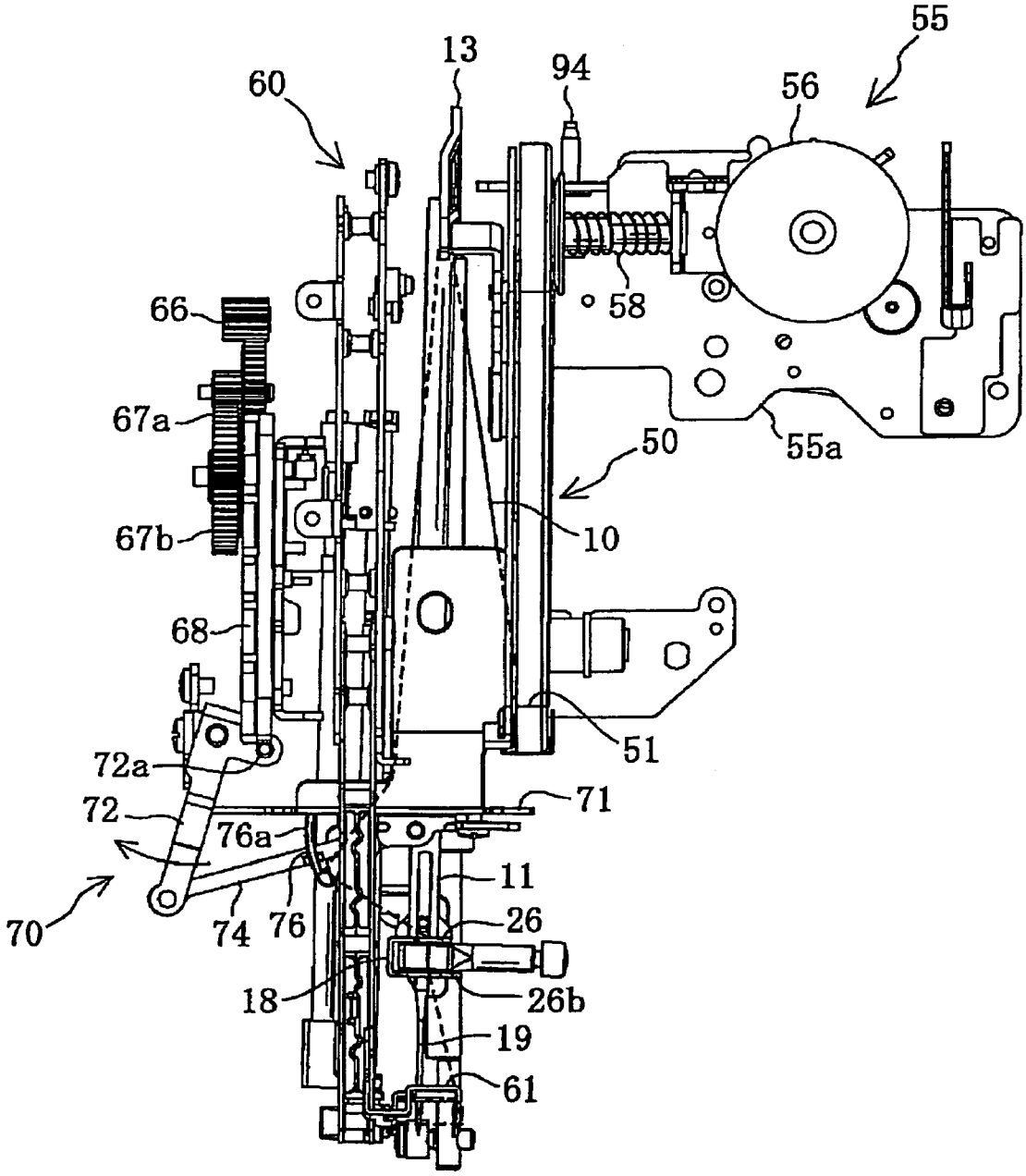
FIG. 20C is a perspective view of the automatic threader and the automatic needle threading mechanism in a condition where a needle bar has been threaded.

Since the first link 72 is biased counterclockwise by an extension coil spring (not shown), the threading hook 76 is usually located at the standby position which is retracted to the right side of the needle bar 11 as shown in FIG. 20A. On the other hand, immediately before the second thread transferring member 61 reaches the thread passing position, the lower end of the rack forming member 68 in downward movement abuts against an actuating pin 72*a* provided on an upper end of the first link 72 from above, pressing the actuating pin 72*a* downward, as shown in FIG. 20C. As a result, the first link 72 is rotated clockwise so that the threading hook 76 is swung about the fourth pivot pin 79 arcuately on a plane in parallel to a vertical plane in front of the needle bar 11, whereupon the threading hook 76 switched from the standby position as shown in FIG. 20B to the threading position as shown in FIG. 20C.

Thus, when the threading hook 76 is swung right in front of the needle bar 11 from the right to the left, the inclined needle thread 10 transferred near to the needle bar thread guide 18 is reliably caught on the hook 76*a* of the threading hook 76. The threading hook 76 is moved in front of the needle bar 11 while holding the needle thread 10. In the middle of the switching from the threading position, the needle thread 10 caught on the threading hook 76 set simultaneously on the first and second needle bar thread guides 26*a* and 26*b* of the needle bar thread guide 18.

The automatic needle threading mechanism 17 will now be described in brief. Referring to FIGS. 8, 9, 17A to 17F, 18A to 18F and 19A to 19F, the automatic needle threading mechanism 17 includes a needle threading shaft 80, a needle threading guide shaft 81, a needle threading slider 82, a hook mechanism 83 and a rotating mechanism (not shown). The needle threading shaft 80 is provided right on the left of the needle bar 11 so as to be vertically movable and vertically directed. The needle threading guide shaft 81 is provided right on the left of the needle threading shaft 80 so as to be vertically movable with the needle threading shaft 80. The needle threading slider 82 is fitted with upper ends of the needle threading shaft 80 and needle threading guide shaft 81 so as to be vertically movable. The hook mechanism 83 has a needle threading hook (not shown) provided on a lower end of the needle threading shaft 80. The rotating mechanism rotates the needle threading shaft 80 about 90 degrees so that the needle threading hook is passed through the thread eye 19*a* of the needle 19 at a lower limit position of the needle threading shaft 80. The slider 82 is vertically moved in synchronization with the rack forming member 68.

Figure 16B:
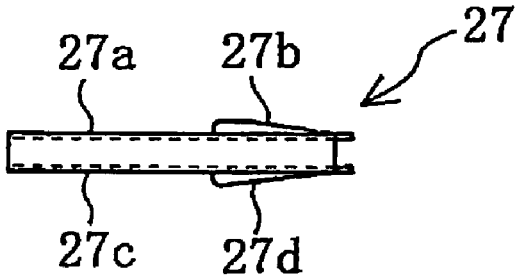
Figure 16C:
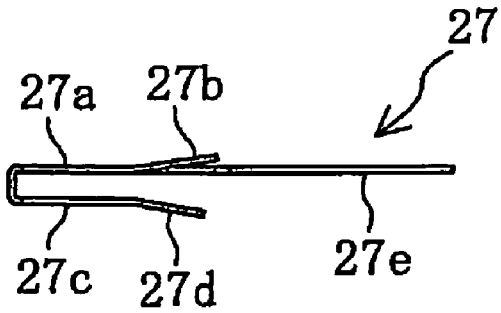

Accordingly, the needle threading mechanism 17 is moved downward in synchronization with the second thread transferring mechanism 60 of the automatic threading-device 16. The needle threading shaft 80 reaches a lower limit position immediately before the second thread transferring member 61 is moved to the thread passing position. The needle threading hook of the hook mechanism 83 is rotated in one direction of reciprocation about 90 degrees such that the needle threading hook is passed through the thread eye 19*a* of the needle 19. At this time, the needle thread 10 held by second thread transferring member 61 is caught on the needle threading hook. Thereafter, the needle threading hook of the hook mechanism 83 is rotated about 90 degrees in the other direction of reciprocation thereby to be pulled out of the thread eye 19*a* of the needle 19. In this case, the needle thread 10 is passed through the thread eye 19*a* and thereafter, the needle threading shaft 80 is moved upward to be returned to the original position. Refer to FIG. 16 of JP-A-2004-41355 about the above-described operations of the needle threading hook and the needle.

The thread preparation path 30 will be described. The thread preparation path 30 is a path preparing the needle thread 10 drawn from the thread spool 9 to be set on a plurality of threaded portions (the thread tension regulator 14, the thread take-up spring 15, the thread take-up lever 13, the needle bar thread guide 18 and the like) by the automatic threading device 16, as described above. The operator manually introduces the needle thread from the thread introduction groove 31 formed in the sewing machine cover 35 previously, so that the thread preparation path 30 is threaded.

Referring to FIGS. 4, 8, 17A and 18A, the thread introducing groove cover 35*b* has a lower right end which is recessed leftward to be formed into a recess 36. Two threading members 90 and 91 are provided which faces outside from the recess 36. A plate-shaped pretensioner 93 is provided between the first guide frame 25 and the threading member 91 inside the sewing machine cover 35. The pretensioner 93 is capable of pressing the needle thread 10 against a receiving plate 92 by a suitable pressing force. A vertically protruding shaft-like threading member 94 is provided on the left of the pretensioner 93. A threading member 95 is provided beneath the right thread holding portion 61*b* of the second thread transferring member 61 assuming the standby position and on the right of a movement locus of the second thread transferring member 61.

The threading member 95 (see FIG. 18A) serves to lock the needle thread 10 at a predetermined position temporarily in order that the needle thread 10 may be set on both thread holding portions 61*a* and 61*b* after start of transfer of the second thread transferring member 61 although the aforesaid construction is not shown. Furthermore, another threading member 96 (see FIG. 4) is provided so as to face a longitudinal groove of the L-shaped introducing groove 34*d* between the thread guide cover 35*d* and the face plate 35*f*.

The needle thread 10 set on the thread preparation path 30 will be processed as follows. The needle thread 10 is drawn leftward from the thread spool 9 and set onto the threading member 90 from above. The needle thread 10 is then set onto a lower threading portion 91*a* of the threading member 91 from below, extending upward. The needle thread 10 is further set onto an upwardly protruding threading portion

91*b* of the threading member 91 from the front, extending through the right and rear of the threading portion 91*b* leftward.

The needle thread 10 extending leftward from the threading portion 91*b* passes between the receiving plate 92 and the pretensioner 93, set onto a shaft-like threading portion 94 from the rear. The needle thread 10 is then set onto the introduction guide portion 43 of the thread take-up lever 13 assuming the threading position from the rear. The needle thread 10 located between the threading portion 94 and the introduction guide portion 43 assumes such a position that the needle thread 10 is reliably set on the first thread transferring member 51 moved from the standby position to the thread passing position along an outer periphery of the first guide frame 52.

The needle thread 10 set on the introduction guide portion 43 of the thread take-up lever 13 extends forward and downward and is then set onto the threading portion 95, extending leftward. The needle thread 10 is then set onto a lower threading portion 96*a* of the threading member 96 and extends upward. The needle thread 10 is then set onto an upper threading portion 96*b* of the threading member 96 thereby to be held. The downstream end of the needle thread 10 is cut by a cutter 97 mounted on the threading member 96.

When the threading portions are threaded as described above, the needle thread 10 between the threading members 95 and 96 extends across a movement path of the paired thread holding portions 61*a* and 61*b* of the second thread transferring member 61. When the thread holding portions 61*a* and 61*b* of the second thread transferring member 61 are moved from the standby position to the thread passing position, the needle thread 10 is reliably caught and transferred.

The sewing machine M thus constructed will be operated as follows. The thread setting of the needle thread 10 is carried out by the above-described the automatic threading device 16 when the needle thread 10 happens to cut off during a sewing operation or the thread spool 9 is changed from one to another. In the automatic threading, the automatic threading preparation switch 23 is operated so that the thread take-up lever 13 not assuming the thread hook position is automatically moved to the thread hook position to be stopped.

Subsequently, the needle thread 10 drawn from the thread spool 9 is inserted sequentially through the introducing grooves 34*a* to 34*d* along the thread introducing groove 3 formed in the sewing machine cover 35. The needle thread 10 is finally turned around so as to straddle the threading member 96 facing the vertical groove of the introducing groove 34*d* from above and set and held on the upper thread holding portion 96*b* temporarily, and a downstream side of the needle thread 10 is cut off by the cutter 97.

The preparation for the threading is thus carried out. Since the needle thread 10 inserted into the thread introducing groove 31 is previously set in the predetermined thread preparation path 30, the needle thread 10 is in a state of readiness to automatically be set on a plurality of the threading portions including the thread take-up lever 13, thread tension regulator 14 and the thread take-up spring 15. More specifically, the first and second thread transferring members 54 and 61 are located at the respective standby positions as shown in FIGS. 17A, 18A and 19A. The needle thread 10 set in the thread preparation path 30 particularly extends across the movement locus of the first thread transferring member 51 and is set on the introduction guide portion 43 from behind. Thus, the needle thread 10 extends across the movement paths of paired thread holding portions 61*a* and 61*b* of the second thread transferring member 61.

When the automatic threading start switch 24 is operated in the aforesaid state, the automatic threading starts. The first and second stepping motors 54 and 69 are driven substantially simultaneously so that thread transfer by the first thread transferring member 51 and thread transfer of the second thread transferring member 61 simultaneously start. Subsequently, the needle thread 10 located between the threading member 94 and the introduction guide portion 43 of the thread take-up lever 13 is transferred downward by the first thread transferring member 51 while caught on the thread hook 54*a*, as shown in FIGS. 17B, 18B and 19B.

Figure 17C:
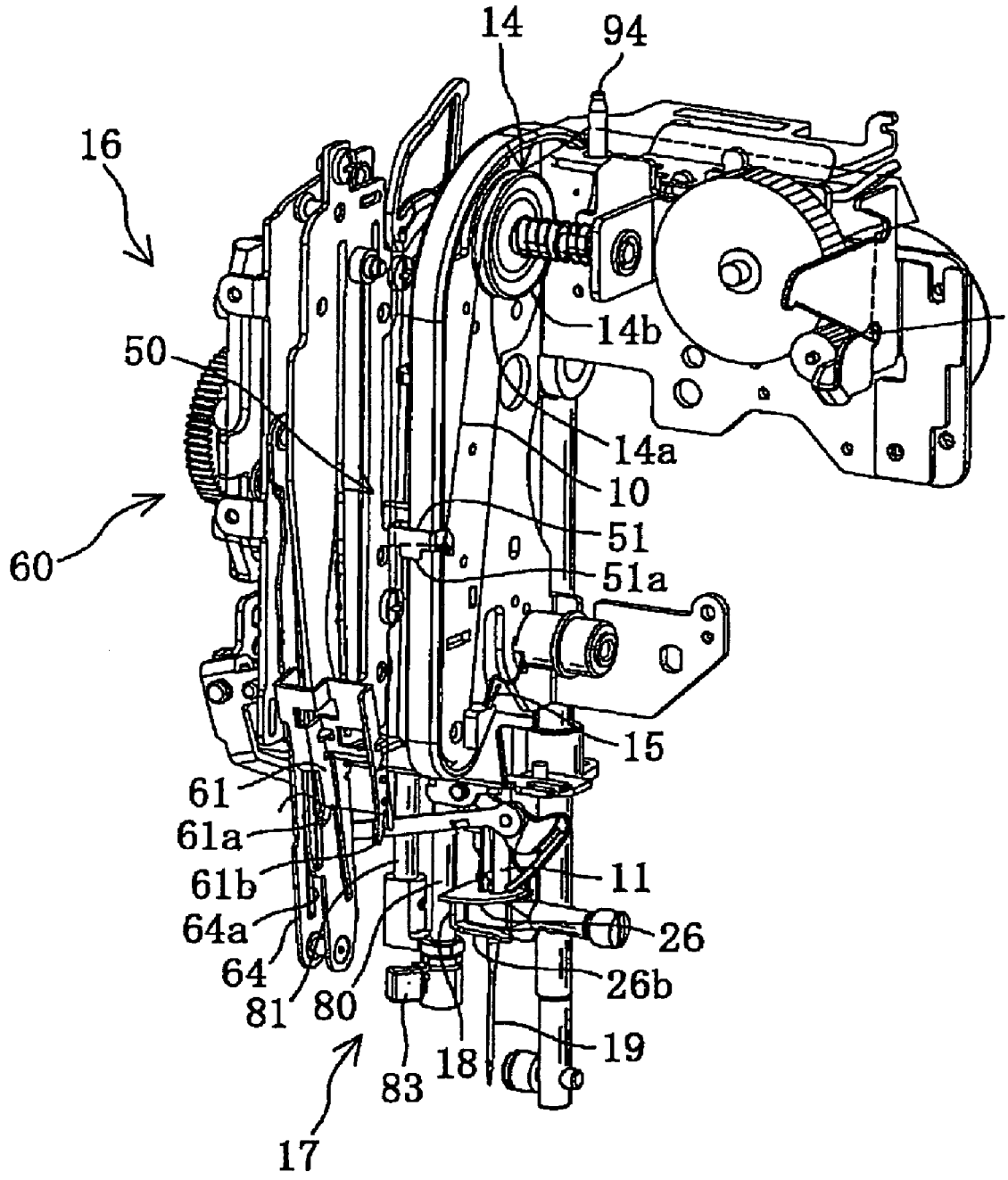
FIG. 17C is a perspective view of the automatic threader and the automatic needle threading mechanism in a condition where the thread take-up lever has been threaded.
Figure 18C:
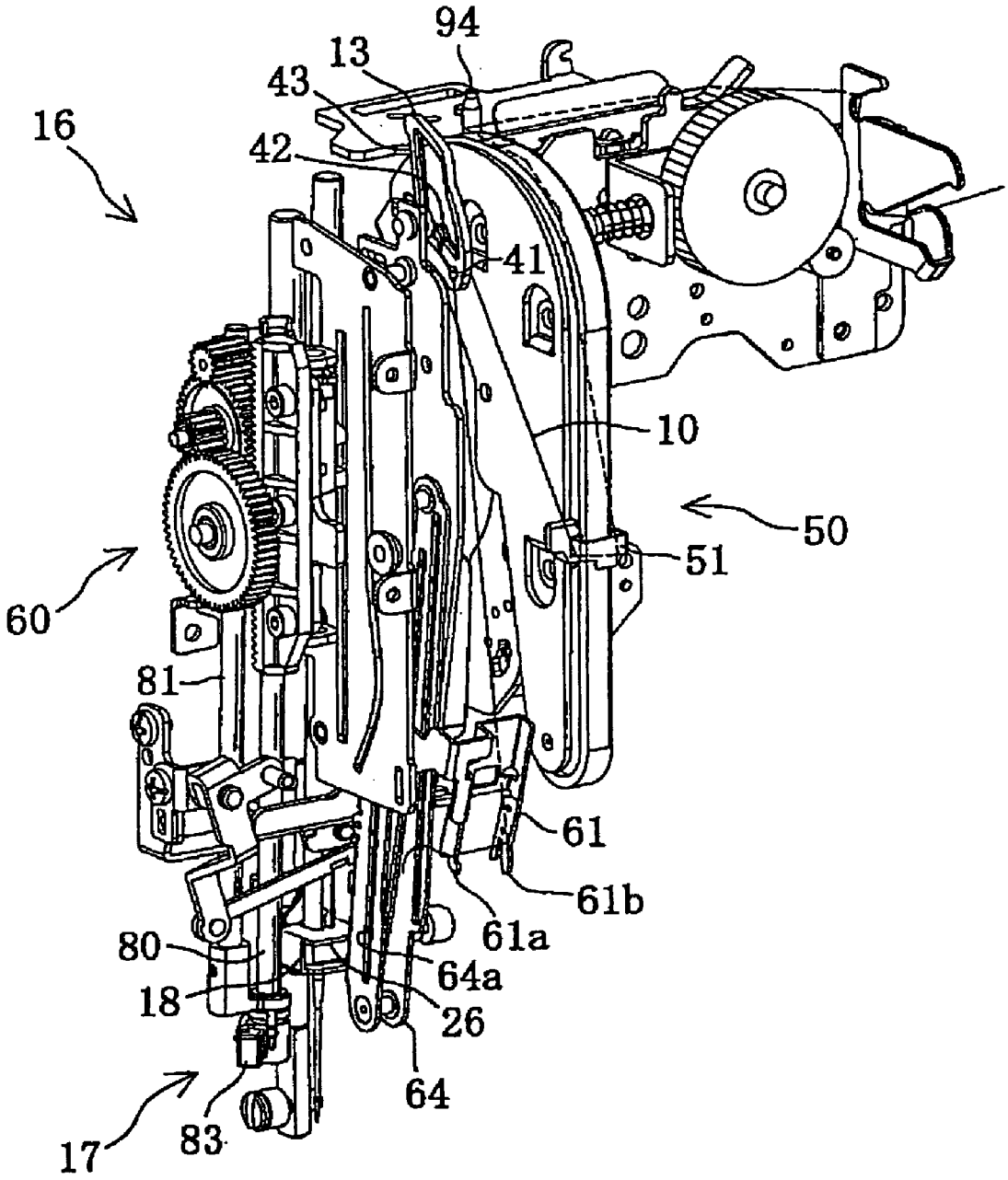
FIG. 18C is a perspective view of the automatic threader and the automatic needle threading mechanism in a condition where the thread take-up lever has been threaded.
Figure 18E:
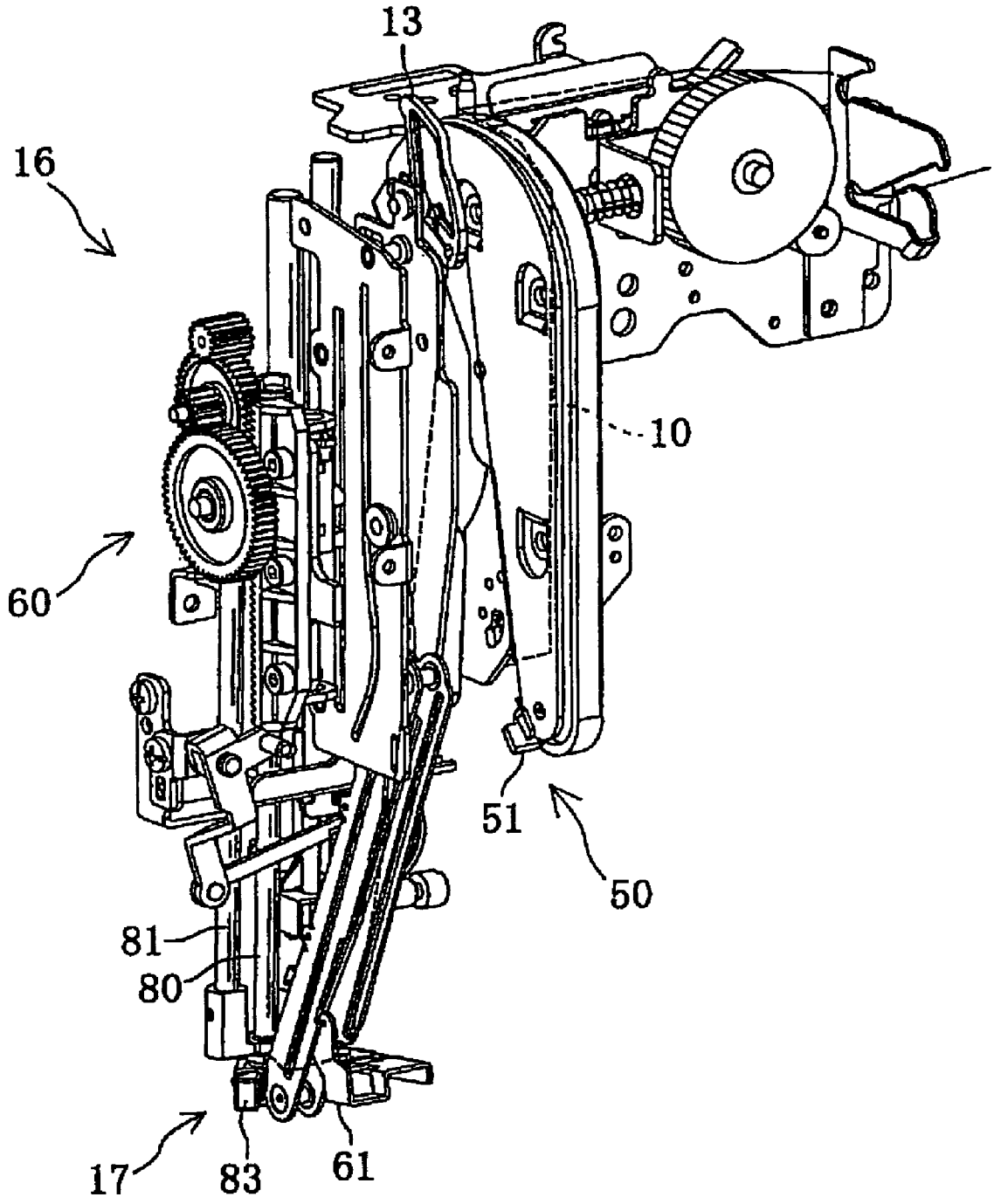
FIG. 18E is a perspective view of the automatic threader and the automatic needle threading mechanism in a condition where the needle thread assumes the thread passing position.
Figure 18F:
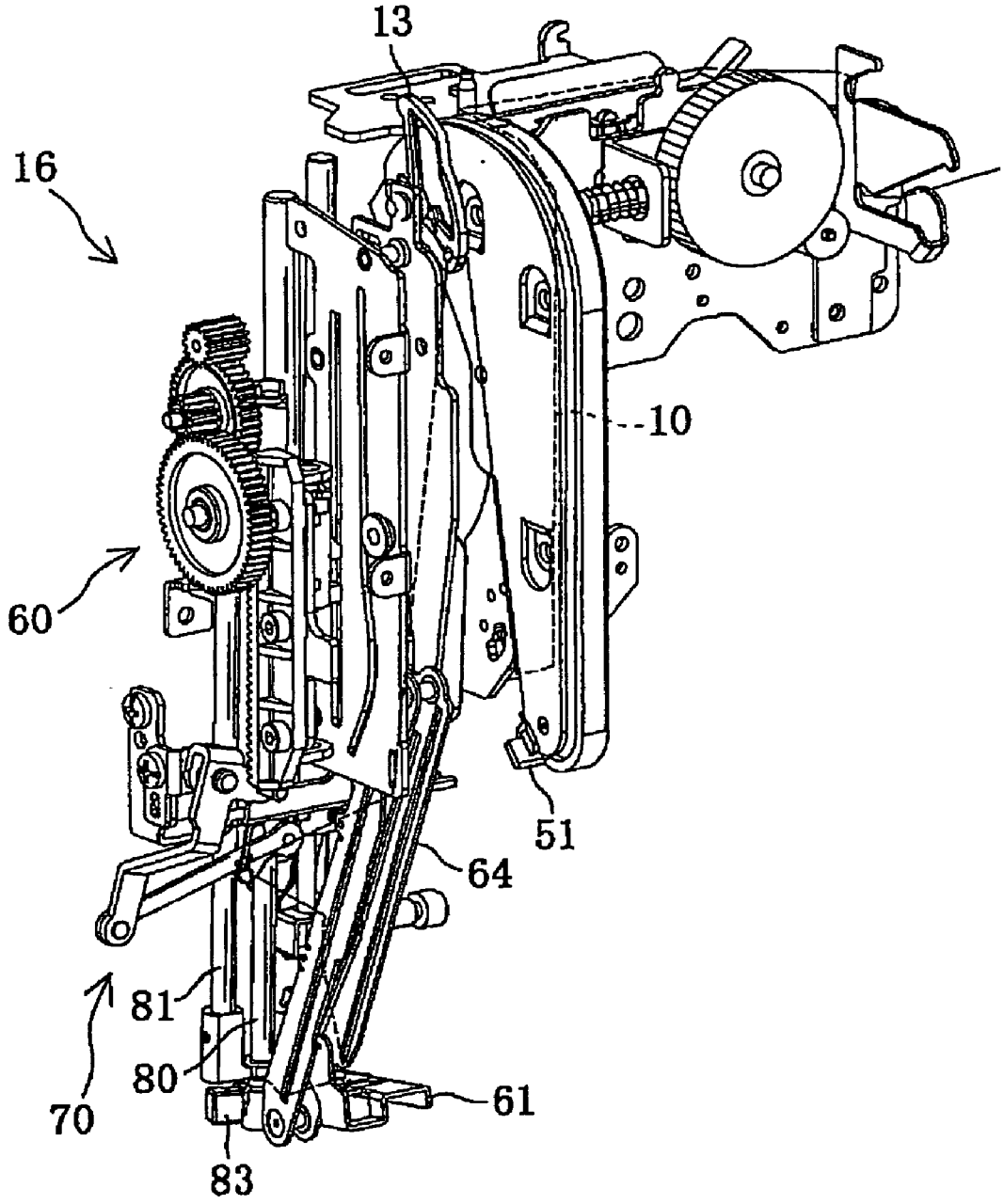
FIG. 18F is a perspective view of the automatic threader and the automatic needle threading mechanism in a condition where a needle bar has been threaded.
Figure 19C:
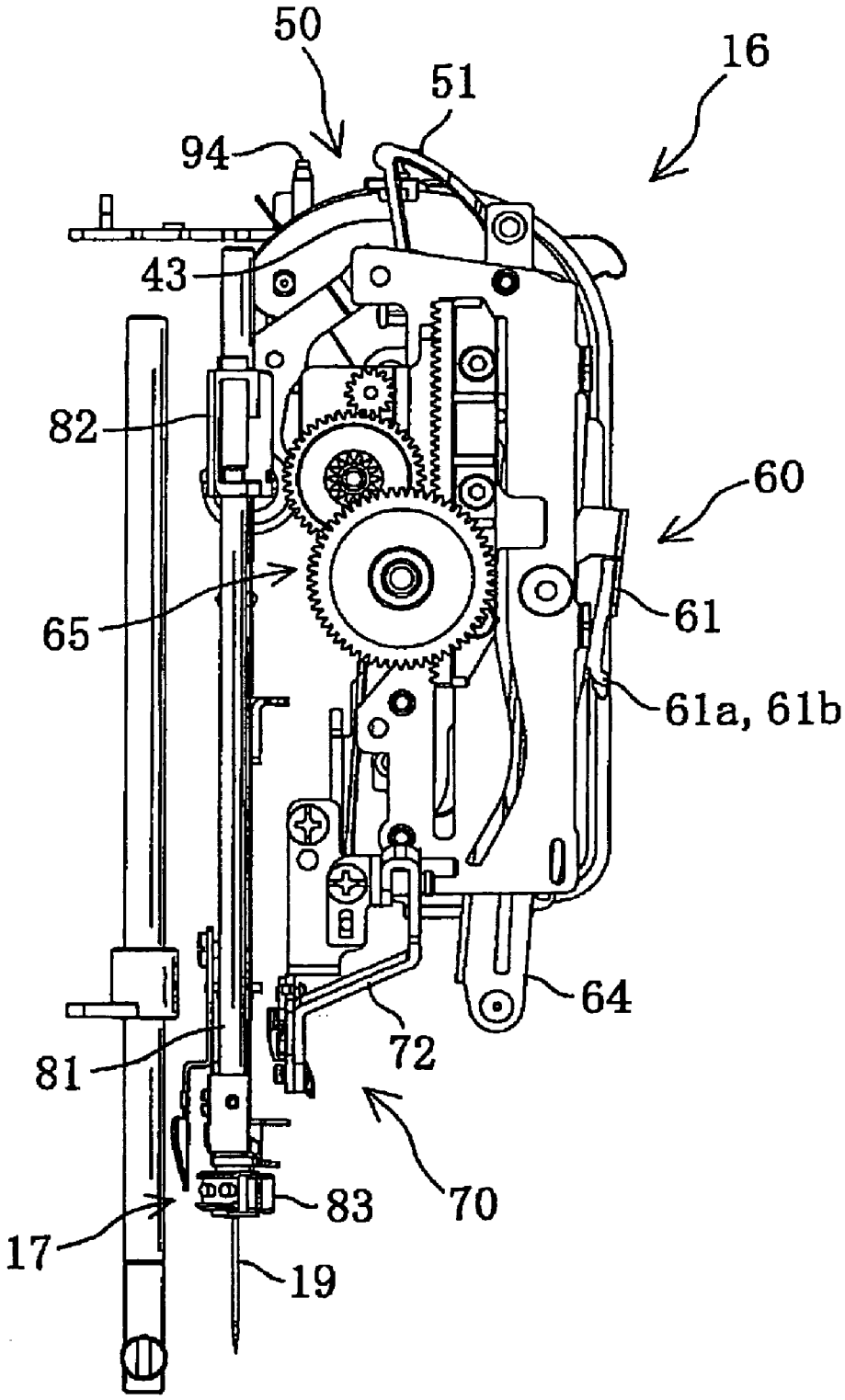
FIG. 19C is a perspective view of the automatic threader and the automatic needle threading mechanism in a condition where the thread take-up lever has been threaded.
Figure 19D:
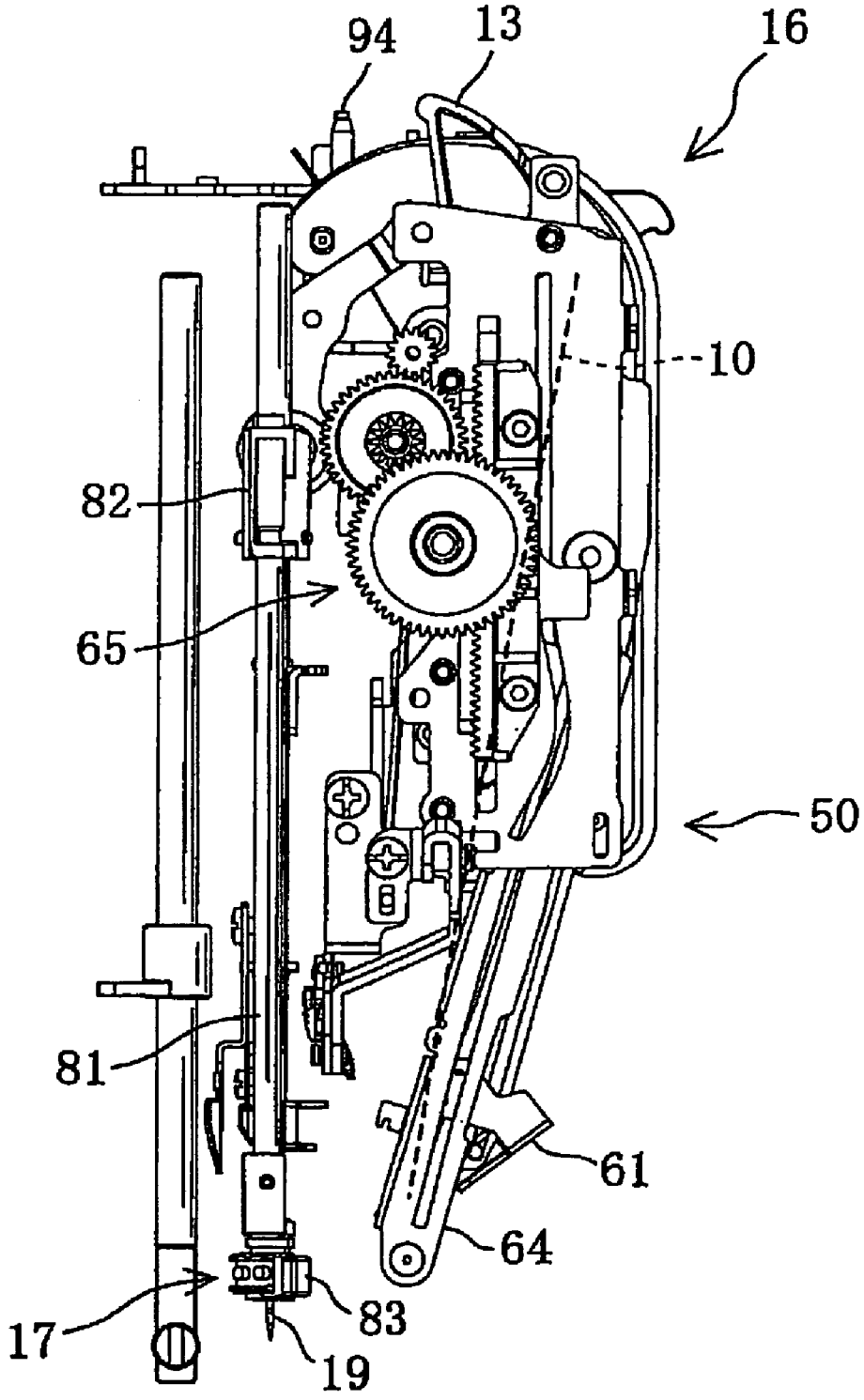
FIG. 19D is a perspective view of the automatic threader and the automatic needle threading mechanism in a condition where the thread take-up spring has been threaded.
Figure 19E:
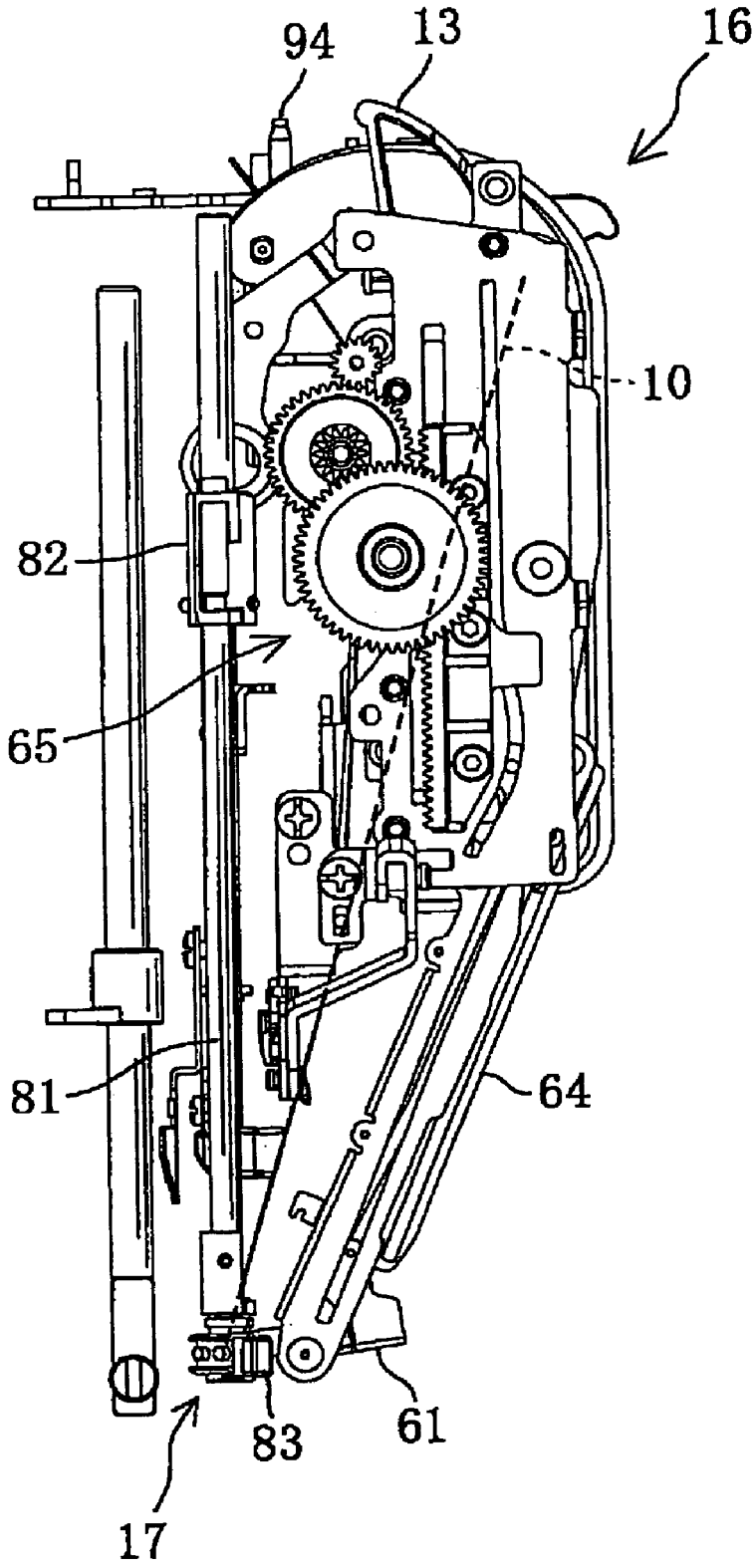
FIG. 19E is a perspective view of the automatic threader and the automatic needle threading mechanism in a condition where the needle thread assumes the thread passing position.
Figure 19F:
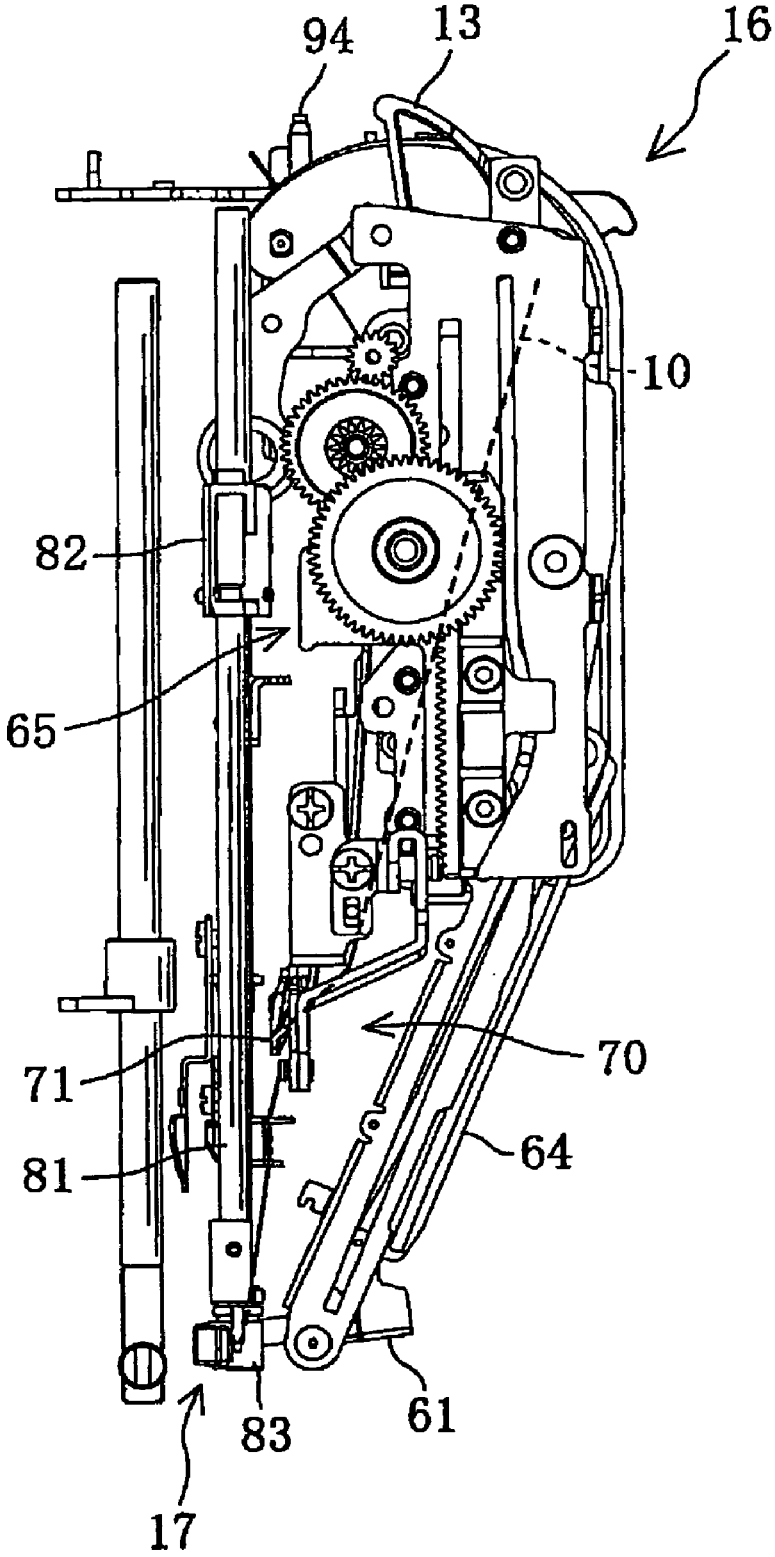
FIG. 19F is a perspective view of the automatic threader and the automatic needle threading mechanism in a condition where a needle bar has been threaded.

Subsequently, when the needle thread 10 is moved downward while caught on the first thread transferring member 51 and held by the second thread transferring member 61, the needle thread 10 from the thread spool 9 is drawn through the thread tension regulator 14 by the downward transfer of the first and second thread transferring members 51 and 61 while being pulled toward the first and second thread transferring members 51 and 61, as shown in FIGS. 17C, 18C and 19C. Accordingly, the introduction guide portion 43 guides, to the lever thread introducing portion 42, the needle thread 10 located between the thread transferring members 51 and 61 and set on the introduction guide portion 43 from behind. The needle thread 10 is then introduced to the lever threaded portion 41 by the lever thread introducing portion 42. Simultaneously, the needle thread 10 extending from the threading member 94 to the first thread transferring member 51 is set between the thread tension discs 14*a* and 14*b* of the open thread tension regulator 14. Furthermore, when the first thread transferring member 51 reaches the thread passing position and the thread transfer is stopped, the needle thread 10 caught by the thread hook 54*a* assumes a position beneath the thread take-up spring 15, as shown in FIGS. 17D, 18D and 19D. At this time, the second thread transferring member 61 assumes a position just before the thread passing position.

Accordingly, since the thread transfer by the second thread transferring member 61 is continuing, the needle thread 10 transferred beneath the thread take-up spring 15 is pulled by the second thread transferring member 61. As shown in FIGS. 17E, 18E and 19E, accordingly, the needle thread 10 transferred beneath the thread take-up spring 15 is introduced into the notch 52*a* and thereafter, set onto the thread take-up spring 15 from below.

Immediately before the second thread transferring member 61 reaches the thread passing position, namely, at a final stage of the threading by the second thread transferring member 61, the lower end of the rack forming member 68 in downward movement presses the actuating pin 72*a* of the first link 72 of the thread guide threading mechanism 70 from above. As a result, the threading hook 76 passes in front of the needle bar 11 to be switched to the threading position as shown in FIGS. 17F, 18F, 19F and 20C. Accordingly, as described above, since the needle thread 10 near the needle bar thread guide 18 is transferred so that the lower part of the needle thread 10 comes nearer to the needle bar thread guide 18 side, the needle thread 10 is reliably caught by the hook 76*a* of the threading hook member 76 swinging on a vertical plane (see FIGS. 22A to 22C). While catching the needle thread 10, the threading hook member 76 passes by in front of the needle bar 11 to be switched to the threading position. During the switching to the threading position, the needle thread 10 caught by the threading hook member 76 is set on the needle bar thread guide 18 so that the needle bar thread guide 18 is threaded.

Figure 23A:
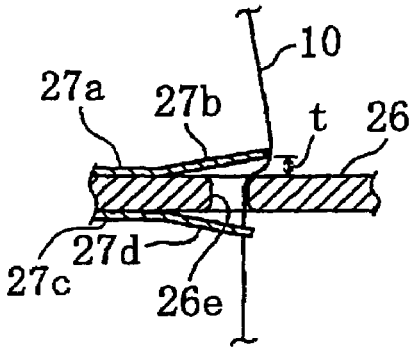
FIG. 23A is a view similar to FIG. 14, showing the condition where the upper fall-off preventing portion is being threaded.
Figure 23B:
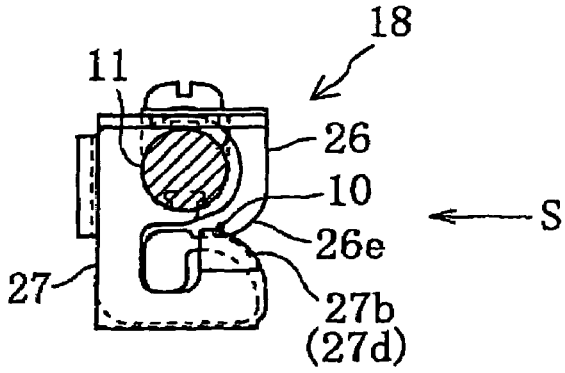
FIG. 23B is a view similar to FIG. 13, showing the condition where the upper fall-off preventing portion is being threaded.
Figure 23C:
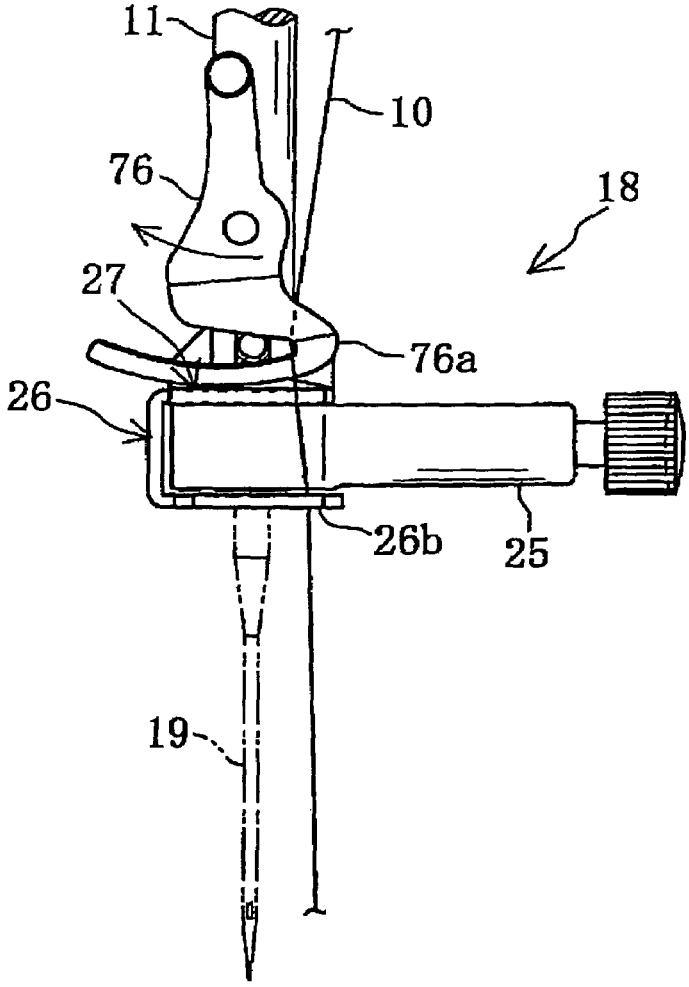
FIG. 23C is a view similar to FIG. 11, showing the condition where the upper fall-off preventing portion is being threaded.

A manner of threading the needle bar thread guide 18 by the threading hook 76 will be described in detail. Firstly, as shown in FIGS. 23A to 23C, when the threading hook 76 is caused to further pivot, the caught needle thread 10 is further moved in the thread introducing direction S (leftward). As a result, while being introduced by the introducing portion 26*e*, the needle thread 10 is bent by the curved edge (the bending start end) of the upper distal end 27*b* of the upper fall-off preventing member 27*a* located upstream in the thread introducing direction S, earlier than the lower fall-off preventing member 27*c* located downstream in the thread introducing direction S in cooperation with the introducing portion 26*e*.

Figure 24A:
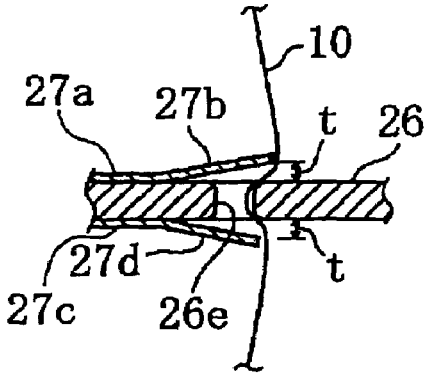
FIG. 24A is a view similar to FIG. 14, showing the condition where the lower fall-off preventing portion is being threaded.
Figure 24B:
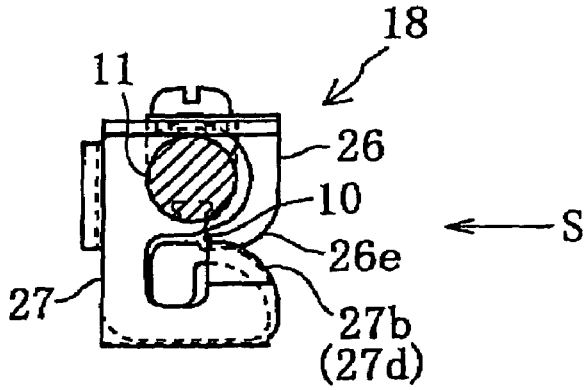
FIG. 24B is a view similar to FIG. 13, showing the condition where the lower fall-off preventing portion is being threaded.
Figure 24C:
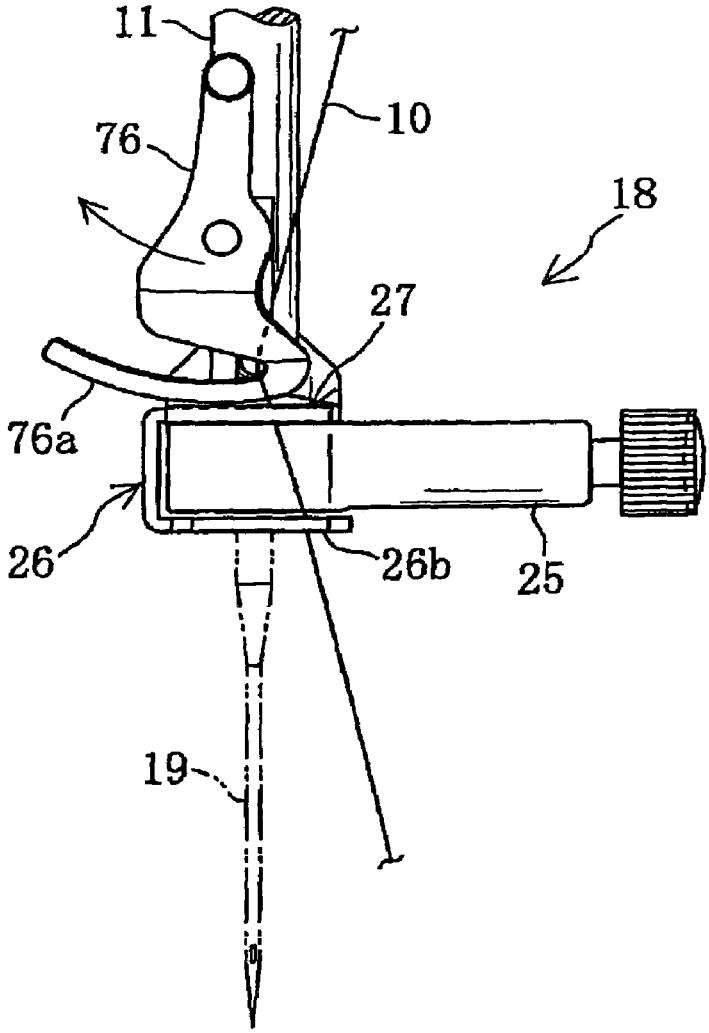
FIG. 24C is a view similar to FIG. 11, showing the condition where the lower fall-off preventing portion is being threaded.

Subsequently, as shown in FIGS. 24A to 24C, further pivotal movement of the threading hook 76 further moves the caught needle thread 10 in the needle thread introducing direction S. As a result, the needle thread 10 is bent by the curved edge (the bending start end) of the lower distal end 27*d* of the lower fall-off preventing member 27*c* located upstream in the thread introducing direction S relative to the curved edge of the upper distal end 27*b* of the upper fall-off preventing member 27*a*, later than the upper fall-off preventing member 27*a* in cooperation with the introducing portion 26*e*.

Figure 25A:
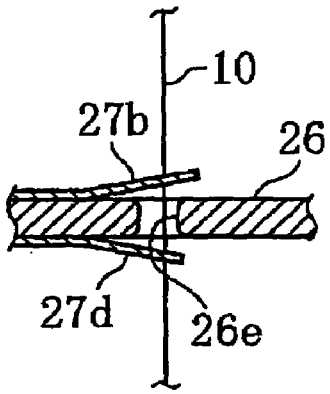
FIG. 25A is a view similar to FIG. 14, showing the condition where threading has been completed.
Figure 25B:
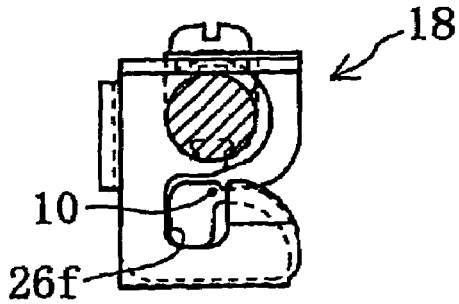
FIG. 25B is a view similar to FIG. 13, showing the condition where threading has been completed.
Figure 25C:
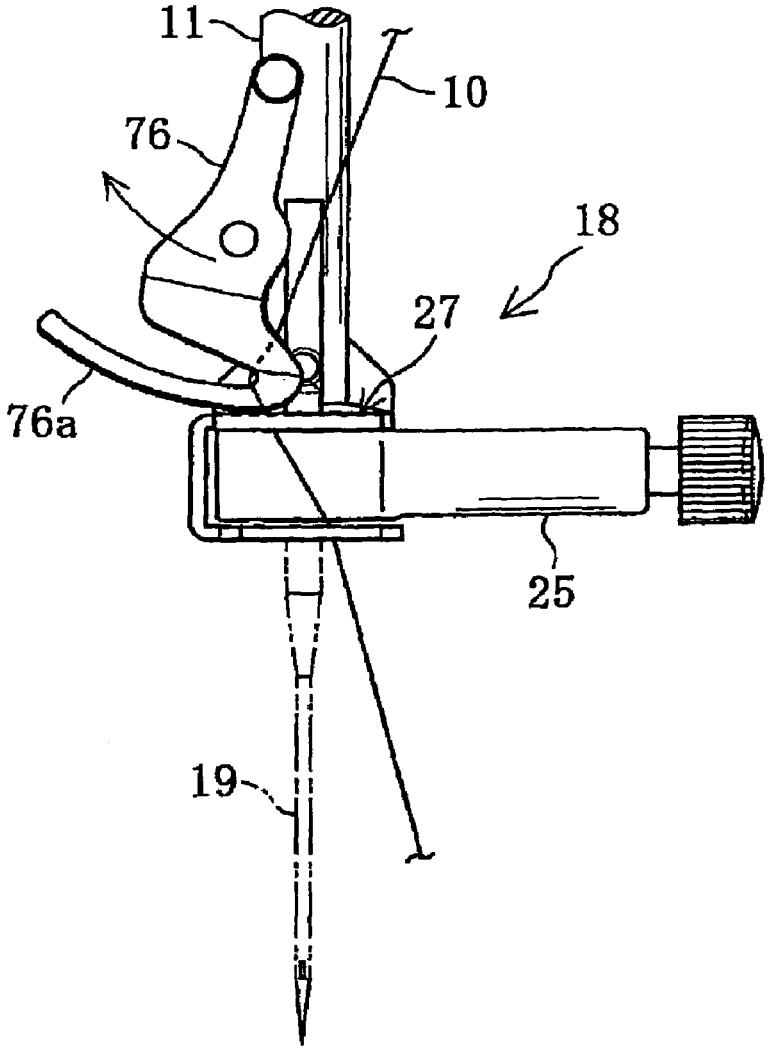
FIG. 25C is a view similar to FIG. 11, showing the condition where threading has been completed.

Finally, as shown in FIGS. 25A to 25C, further pivotal movement of the threading hook 76 further moves the needle thread 10 caught by the threading hook 76 leftward. As a result, the needle thread 10 is released from the bending by the upper and lower distal ends 27*b* and 27*d*, so that the needle thread 10 is set on the threading portion 26*f* so that the threading portion 26*f* is threaded (see FIG. 10).

On the other hand, the needle threading guide shaft 81 starts to move downward in synchronization with the automatic threading device 16. When the second thread transferring member 61 reaches the second thread passing position, the needle threading shaft 80 and the needle threading guide shaft 81 are moved downward together with the needle threading slider 82, whereupon the needle threading hook reaches the same level as the thread eye 19*a* of the needle 19. As a result, the downward movement of the needle threading shaft 80 and the needle threading guide shaft 81 is stopped.

Subsequently, when the needle threading slider 82 is further moved downward, the needle threading hook of the hook mechanism 83 is rotated about a vertical axis by the rotating mechanism so that the threading hook is passed through the thread eye 19*a*, and the needle thread 10 held by the second thread transferring member 61 is caught on the needle threading hook. Thereafter, the needle threading hook of the hook mechanism 83 is rotated in the reverse direction so that the needle threading hook is pulled through the thread eye 19*a* such that the needle thread 10 is passed through the thread eye 19*a*.

Subsequently, the needle threading slider 82, the needle threading shaft 80 and the needle threading guide shaft 81 are moved upward to original positions respectively. Furthermore, the first and second thread transferring members 54 and 61 are also returned to original positions respectively. Accordingly, the threading regarding all the threading portions is completed at this time, whereupon the sewing machine is in a sewable state.

As described above, the needle bar thread guide 18 has a threading portion 26*f* on which the needle thread 10 is set so that the sewing machine M is threaded. The needle bar thread guide 18 is disposed on the lower end of the needle bar 11. Since the introducing portion 26*e* and the fall-off preventing member 27 are provided, the needle thread 10 can readily be introduced via the introducing portion 26*e* to the threading portion 26*f* without any obstruction by the fall-off preventing member 27. Furthermore, the needle thread 10 introduced to the threading portion 26*f* can reliably be prevented from falling off from the needle bar thread guide 18 by the fall-off preventing member 27 provided on the upper and lower sides of the needle bar thread guide 18 respectively.

Furthermore, the fall-off preventing member 27 has the upper and lower fall-off preventing portions 27*a* and 27*c*. The upper and lower fall-off preventing portions 27*a* and 27*c* are constructed to bend the needle thread 10 in cooperation with the introducing portion 26*e* when the needle thread 10 is introduced to the threading portion 26*f*. Consequently, the needle thread 10 to be set can readily be introduced to the threading portion 26*f* while being bent by the upper and lower fall-off preventing portions 27*a* and 27*c*. Moreover, the needle thread 10 once introduced to the threading portion 26*f* is loosened when the thread take-up lever 13 is moved downward during sewing. However, even when loosened, the needle thread 10 cannot be returned to the bent state as when introduced. Consequently, the needle thread 10 can be prevented from falling off. Thus, reliable needle thread introduction and fall-off prevention can be achieved by a simple construction.

Furthermore, the bending start end of the upper distal end 27*b* is located upstream in the needle thread introducing direction S by the predetermined dimension relative to the bending start end of the lower distal end 27*d*. As a result, the time the needle thread 10 is bent by the upper fall-off preventing member 27*a* is earlier than the time the needle thread 10 is bent by the lower fall-off preventing member 27*c*. Consequently, resistance of introduction of the needle thread 10 can be reduced when the needle thread 10 is bent by the upper fall-off preventing portion 27*a* and is further bent by the lower fall-off preventing portion 27*c* with time lag as compared with the case where the needle thread 10 is bent simultaneously by the upper and lower fall-off preventing portions 27*a* and 27*c*, whereupon reliability in the introduction of the needle thread 10 can be improved.

Furthermore, the introducing portion 26*e* is constructed to leftward move the needle thread 10 directed approximately in parallel to the needle bar 11 so that the needle thread 10 is introduced to the threading portion 26*f*. The upper and lower fall-off preventing portions 27*a* and 27*c* provide the predetermined gap t through which the needle thread 10 can be passed and which overlaps a part of the upper fall-off preventing portion 27*a*. Accordingly, the needle thread 10 can be moved through the predetermined gap t while being bent by the upper fall-off preventing member 27*a* and the introducing portion 26*e* partially overlapping the upper fall-off preventing member 27*a*. Moreover, the needle thread 10 can also be moved through the predetermined gap t while being bent by the lower fall-off preventing member 27*c* and the introducing portion 26*e* partially overlapping the lower fall-off preventing member 27*c*. Consequently, reliable introduction of the needle thread 10 to the introducing portion 26*e* and fall-off prevention can be achieved by a simple construction.

Furthermore, the needle bar thread guide 18 has the first and second needle bar thread guides 26*a* and 26*b* vertically spaced away from each other. The fall-off preventing member 27 is provided on the upper first needle bar thread guide 26*a*. Consequently, even when the needle thread 10 is loosened between the thread take-up lever 13 and the first needle bar thread guide 26*a* during downward movement of the thread take-up lever 13, the loosened needle thread 10 can effectively be coped with and accordingly can reliably be prevented from falling off.

Figure 26:
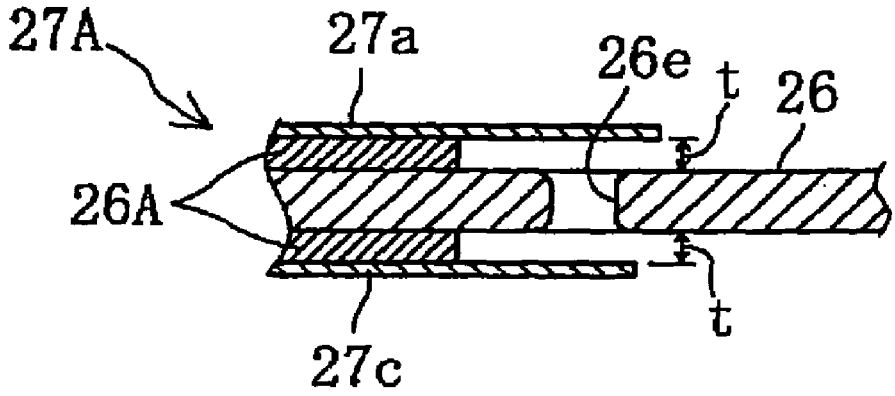
FIG. 26 is a view similar to FIG. 14, showing a first modified form of the embodiment.

The above-described embodiment may be modified as follows. Firstly, in a first modified form as shown in FIG. 26, the upper and lower fall-off preventing portions 27*a* and 27*c* of the plate-shaped fall-off preventing member 27A may be fixed via spacers 26A to the thread guide body 26. In this case, each spacer 26A has a thickness corresponding to the predetermined gap t through which the needle thread 10 can be passed. In this construction, the distal end of the fall-off preventing member 27A need not be bent.

Figure 27:
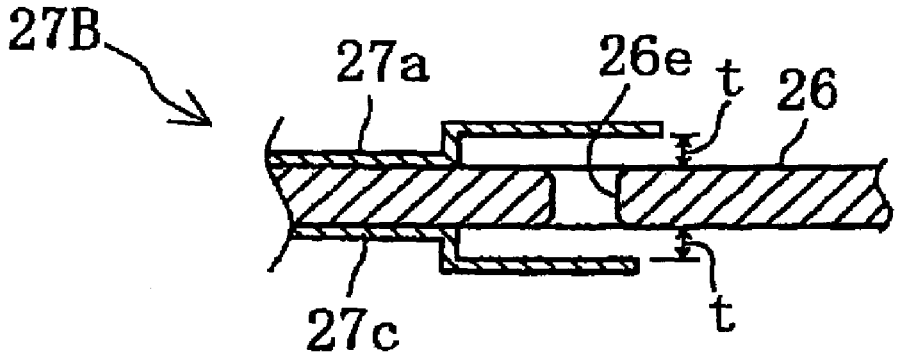
FIG. 27 is a view similar to FIG. 14, showing a second modified form of the embodiment.

Furthermore, in a second modified form as shown in FIG. 27, the upper and lower fall-off preventing members 27*a* and 27*c* may have respective portions located at the introducing portion 26*e* and the portions may partially be formed into a cranked shape so that the distal end of the fall-off preventing member 27A is provided with the predetermined gap t through which the needle thread 10 can be passed.

Various changes and modifications other than described above may be added to the needle bar thread guide 18 and the like within the scope of the present invention. Furthermore, the invention may be applied to various types of household and industrial sewing machines.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A needle bar thread guide for a sewing machine, the sewing machine including at least one needle bar, the thread guide comprising:

a thread guide body provided on the needle bar and having a threading portion for threading the sewing machine;

an introducing portion provided on the thread guide body for introducing a needle thread to the threading portion; and a fall-off preventing member provided at a position above and below the thread guide body, the fall-off preventing member allowing the needle thread to be introduced via the introducing portion to the threading portion and preventing the needle thread introduced to the threading portion from falling off from the introducing portion.

2. The needle bar thread guide according to claim 1, wherein the fall-off preventing member is provided at a position above and below the introducing portion.

3. The needle bar thread guide according to claim 2, wherein the fall-off preventing member has an upper fall-off preventing portion and a lower fall-off preventing portion, and the upper fall-off preventing portion bends the needle thread in cooperation with the introducing portion when the needle thread is introduced to the threading portion.

4. The needle thread guide according to claim 3, wherein the lower fall-off preventing portion bends the needle thread in cooperation with the introducing portion when the needle thread is introduced to the threading portion.

5. The needle thread guide according to claim 4, wherein when the needle thread is introduced to the threading portion, a time the upper fall-off preventing portion starts bending the needle thread is differentiated from a time the lower fall-off preventing portion starts bending the needle thread.

6. The needle thread guide according to claim 5, wherein:

the upper and lower fall-off preventing portions are provided with bend starting ends abutting the needle thread against the upper and lower fall-off preventing portions thereby to bend the needle thread respectively; and the bend starting end of the upper fall-off preventing portion is located upstream by a predetermined distance relative to the bend starting end of the lower fall-off preventing portion in a direction of introduction of the needle thread to the introducing portion, so that the upper fall-off preventing portion starts bending the needle thread before the lower fall-off preventing portion starts bending the needle thread.

7. The needle thread guide according to claim 4, wherein:

the introducing portion moves leftward or rightward the needle thread directed substantially in parallel to the needle bar; and the upper and lower fall-off preventing portions are provided so as to overlap a part of the introducing portion with a predetermined gap being defined therebetween when the needle thread is introduced to the introducing portion, the needle thread being allowed to pass through the gap by bending.

8. The needle thread guide according to claim 1, wherein the thread guide body has first and second needle bar thread guides provided so as to be spaced vertically away from each other, and the fall-off preventing member is provided on the upper first needle bar thread guide.

* * * * *